US012471701B1

(12) United States Patent
Luo

(10) Patent No.: US 12,471,701 B1
(45) Date of Patent: Nov. 18, 2025

(54) SHELF

(71) Applicant: Shenzhen Baite Youpin Supply Chain Co., Ltd., Shenzhen (CN)

(72) Inventor: Shaoyuan Luo, Shenzhen (CN)

(73) Assignee: Shenzhen Baite Youpin Supply Chain Co., Ltd., Shenzhen (CN)

( * ) Notice: Subject to any disclaimer, the term of this patent is extended or adjusted under 35 U.S.C. 154(b) by 0 days.

(21) Appl. No.: 19/014,739

(22) Filed: Jan. 9, 2025

(30) Foreign Application Priority Data

Jan. 3, 2025 (CN) ..... 202520009495.8

(51) Int. Cl.

| | |
|---|---|
| ***A47B 57/52*** | (2006.01) |
| ***A47B 57/16*** | (2006.01) |
| ***A47B 57/30*** | (2006.01) |
| *A47B 47/00* | (2006.01) |
| *A47B 47/02* | (2006.01) |
| *A47B 57/06* | (2006.01) |
| *A47B 57/48* | (2006.01) |

(52) U.S. Cl.
CPC ..... *A47B 57/52* (2013.01); *A47B 57/16* (2013.01); *A47B 57/30* (2013.01); *A47B 47/0083* (2013.01); *A47B 47/028* (2013.01); *A47B 57/06* (2013.01); *A47B 57/48* (2013.01)

(58) Field of Classification Search
CPC ..... A47B 57/52; A47B 47/00; A47B 47/0083; A47B 47/021; A47B 47/028; A47B 47/045; A47B 57/06; A47B 57/08; A47B 57/10; A47B 57/16; A47B 57/20; A47B 57/30; A47B 57/34; A47B 57/48
See application file for complete search history.

(56) References Cited

U.S. PATENT DOCUMENTS 1,014,889 A * 1/1912 McDonald ..... A47B 45/00 211/175
1,829,009 A * 10/1931 Madsen ..... A47B 57/485 5/11
1,852,598 A * 4/1932 Vogt ..... A47B 57/425 248/222.51
1,853,018 A * 4/1932 Knape ..... A47B 57/425 248/243
3,225,940 A * 12/1965 Story ..... A47G 25/0692 108/30
3,352,429 A * 11/1967 Magnuson ..... A47G 25/06 211/113
4,101,108 A * 7/1978 Klein ..... A47B 57/40 248/301
4,201,139 A * 5/1980 Suttles ..... A47B 57/40 108/109

(Continued)

*Primary Examiner* — Devin K Barnett

(57) ABSTRACT

A shelf includes a support arm part, a support foot part, a locking device. The support foot part is used for supporting the support arm part. The locking device is used for detachably locking the support arm part to the support foot part, so that the support arm part and the support foot part can be locked to each other through a locking part. During the process of disassembling and assembling the support foot part and the support arm part, only the locking of the support foot part and the support arm part by the locking device needs to be released, and the support foot part and the support arm part will not be damaged, so that the shelf can be repeatedly disassembled and assembled.

11 Claims, 26 Drawing Sheets

(56) References Cited

U.S. PATENT DOCUMENTS 4,658,967 A * 4/1987 Wang ..... A47G 25/0678 211/94.01
4,681,289 A * 7/1987 Gronlund ..... A47B 88/43 248/224.8
5,463,966 A * 11/1995 Nilsson ..... F16B 12/34 108/193
5,553,549 A * 9/1996 Nilsson ..... A47B 9/00 108/147.11
5,687,856 A * 11/1997 Kendrena ..... A47L 13/512 211/94.01
5,720,398 A * 2/1998 Kump ..... A47F 5/0068 211/186
5,740,927 A * 4/1998 Yemini ..... A47F 5/0853 211/94.01
5,743,416 A * 4/1998 Yemini ..... B25H 3/04 248/220.42
5,908,119 A * 6/1999 Kump ..... A47F 5/0068 211/186
7,798,463 B2 * 9/2010 Morgenroth ..... A47F 5/0846 211/106.01
7,900,781 B2 * 3/2011 Baine ..... A47F 5/0838 211/106.01
7,980,614 B2 * 7/2011 Denton ..... B60R 7/04 296/37.16
8,157,230 B2 * 4/2012 Krueger ..... A47B 96/068 248/222.51
9,301,610 B1 * 4/2016 Berry ..... F16B 12/02
9,603,468 B2 * 3/2017 Nilsson ..... A47F 5/0018
10,626,905 B1 * 4/2020 Chiu ..... A47B 57/545
11,006,750 B2 * 5/2021 Chiu ..... A47B 96/06
11,039,686 B2 * 6/2021 Min ..... A47B 47/0083
11,344,114 B2 * 5/2022 Li ..... A47B 47/028
11,622,625 B2 * 4/2023 Han ..... A47B 47/02 211/86.01
12,070,124 B2 * 8/2024 Whitta ..... A47B 47/0083
D1,059,999 S * 2/2025 Yoon ..... D8/349
2005/0103733 A1 * 5/2005 Saltzberg ..... A47B 96/00 211/187
2005/0103734 A1 * 5/2005 Saltzberg ..... A47B 96/1441 211/187
2008/0053940 A1 * 3/2008 Whalen ..... A47F 5/0043 211/134
2010/0084354 A1 * 4/2010 Eustace ..... A47F 5/00 211/183
2011/0056897 A1 * 3/2011 Kao ..... A47F 7/0028 248/220.31
2011/0062100 A1 * 3/2011 Webb ..... A47B 53/00 211/183
2011/0272541 A1 * 11/2011 Wojtowicz ..... A47F 5/14 248/218.4
2014/0034593 A1 * 2/2014 Chen ..... A47B 57/50 211/208
2014/0263136 A1 * 9/2014 Reinhart ..... A47B 47/045 211/186
2014/0263137 A1 * 9/2014 Reinhart ..... A47B 47/045 211/186
2015/0282613 A1 * 10/2015 Chen ..... A47B 96/021 211/187
2015/0313357 A1 * 11/2015 David ..... A47B 47/027 211/187
2017/0347793 A1 * 12/2017 Wang ..... A47B 57/22
2018/0344031 A1 * 12/2018 Wang ..... B25H 3/04
2019/0125077 A1 * 5/2019 Liss ..... A47B 47/027
2019/0290000 A1 * 9/2019 Davis ..... A47F 5/13
2020/0253374 A1 * 8/2020 Lu ..... A47B 96/1408
2022/0110450 A1 * 4/2022 Parab ..... A47B 47/021
2024/0065439 A1 * 2/2024 Flowers ..... B25H 3/04

* cited by examiner

SHELF

CROSS-REFERENCE TO RELATED APPLICATIONS

The application claims priority of Chinese patent application CN2025200094958, filed on Jan. 3, 2025, which is incorporated herein by reference in its entireties.

TECHNICAL FIELD

The present invention relates to the field of storage shelves, particularly to a shelf.

BACKGROUND ART

For existing shelves on the market, support feet, support arms, and support plates of the shelves are usually connected by integral molding or are connected fixedly. Although the installation by users is not required, it is difficult to disassemble and carry the shelves. For example, when users need to transport the shelves, since the shelves are large in overall size and heavy in weight, and the shelves cannot be disassembled, it is difficult to transport the shelves. In particular, when encountering narrow doors, roots of larger shelves cannot pass through the narrow doors, causing great inconvenience to users. Therefore, there is an urgent need on the market to provide a detachable, easy to transport, and structurally stable shelf to improve the user experience.

SUMMARY

In order to overcome the shortcomings of the prior art, a shelf is provided in the present invention. The shelf includes:

- a support arm part;
- a support foot part, wherein the support foot part is used for supporting the support arm part; and
- a locking device, wherein the locking device is used for detachably locking the support arm part to the support foot part.

Beneficial effects of the present invention are as follows. The shelf is provided in the present invention. The shelf includes the support arm part, the support foot part, and the locking device. The support foot part is used for supporting the support arm part. The locking device is used for detachably locking the support arm part to the support foot part, so that the support arm part and the support foot part can be locked to each other through a locking part, making the installation and disassembly between the support arm part and the support foot part simpler and faster. Moreover, during the process of disassembling and assembling the support foot part and the support arm part, only the locking of the support foot part and the support arm part by the locking device needs to be released, and the support foot part and the support arm part will not be damaged, so that the shelf can be repeatedly disassembled and assembled to meet needs of a user in different scenes. For example, it is convenient for the user to disassemble the shelf before transporting the shelf, and also convenient for the user to install the shelf again after transporting the shelf.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
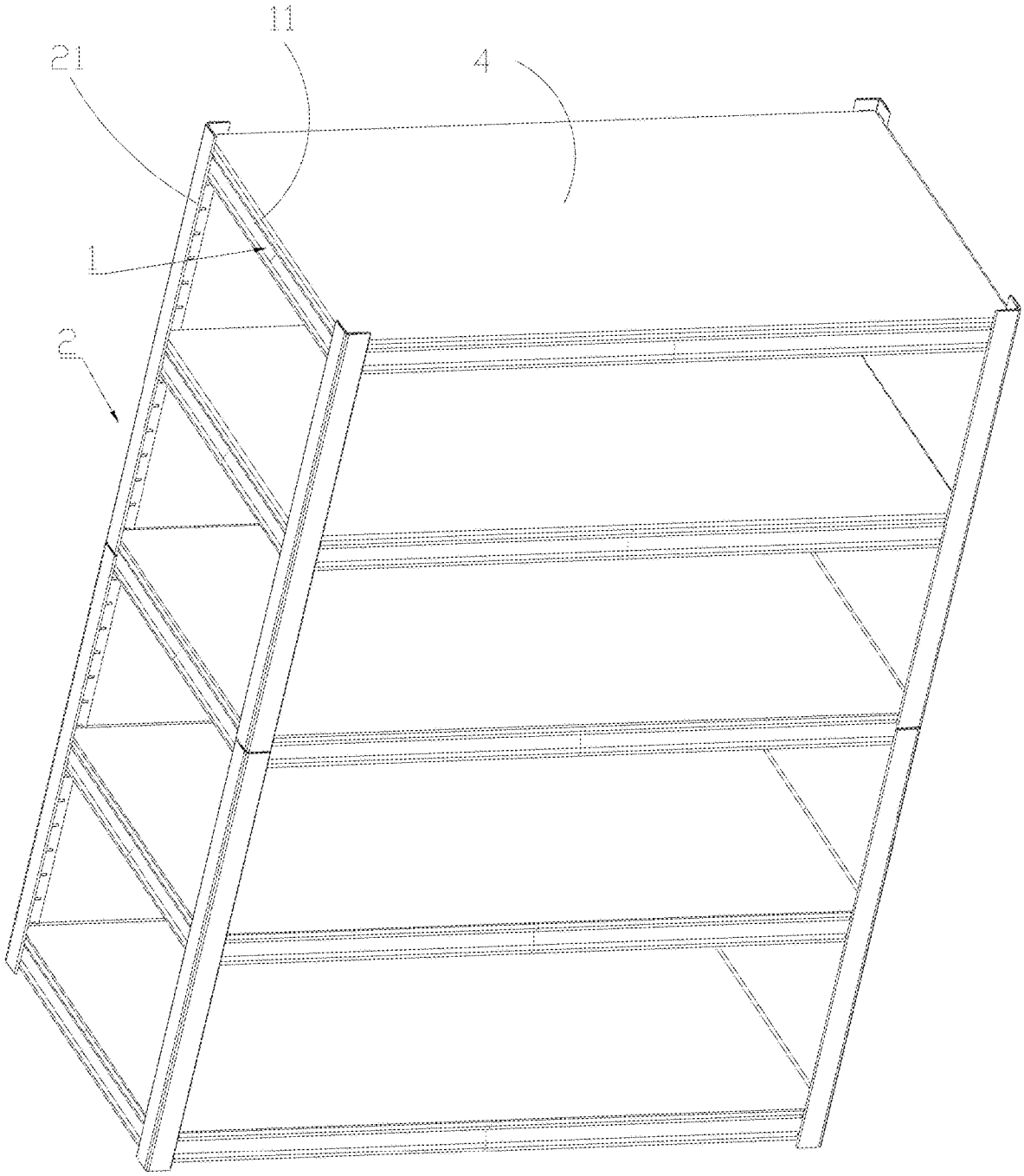
FIG. 1 is a schematic diagram of an overall structure of the present invention when a first locking portion is a first elastic wall and a second locking portion is a first hook.
Figure 2:
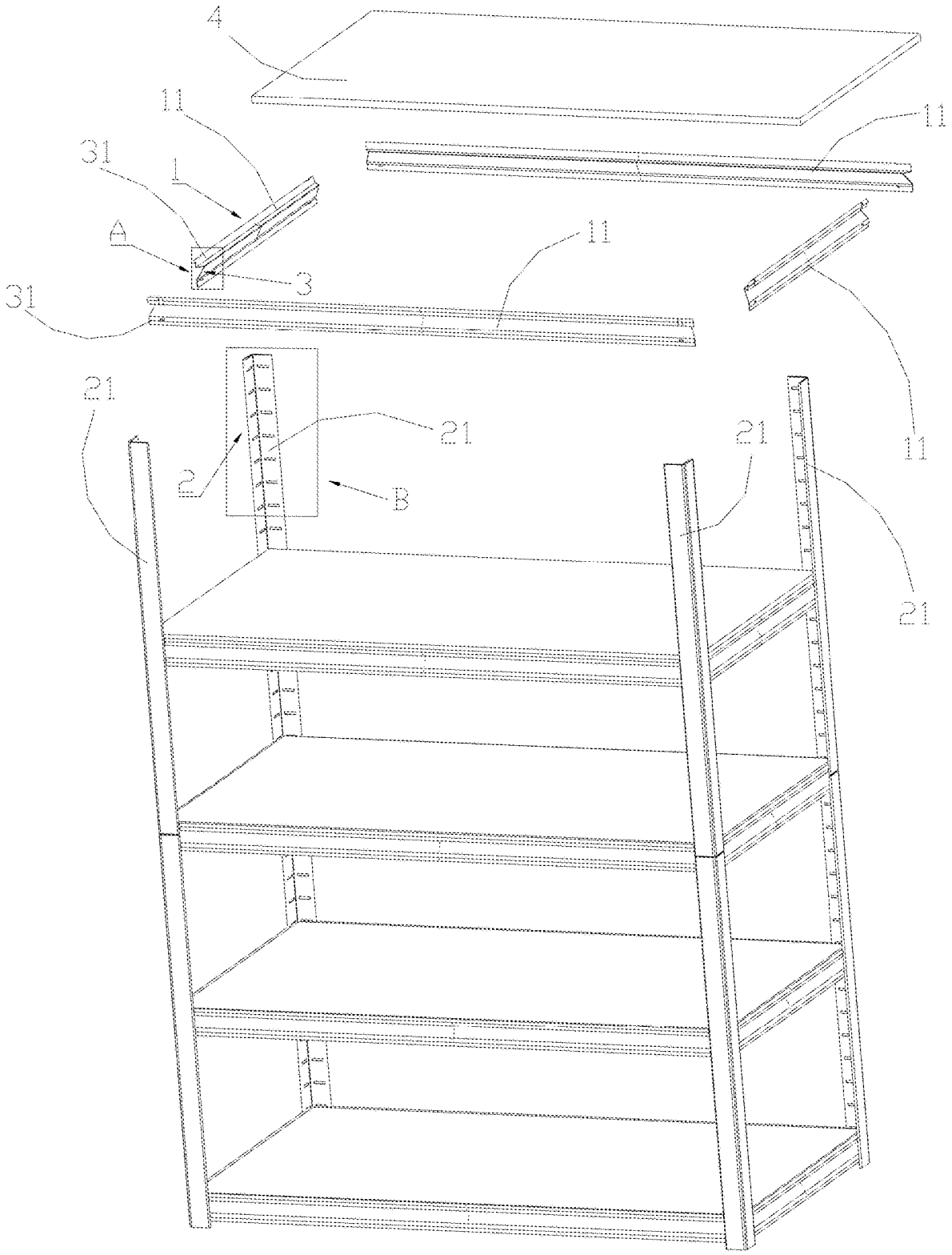
FIG. 2 is an exploded view of the present invention when a first locking portion is a first elastic wall and a second locking portion is a first hook.
Figure 3:
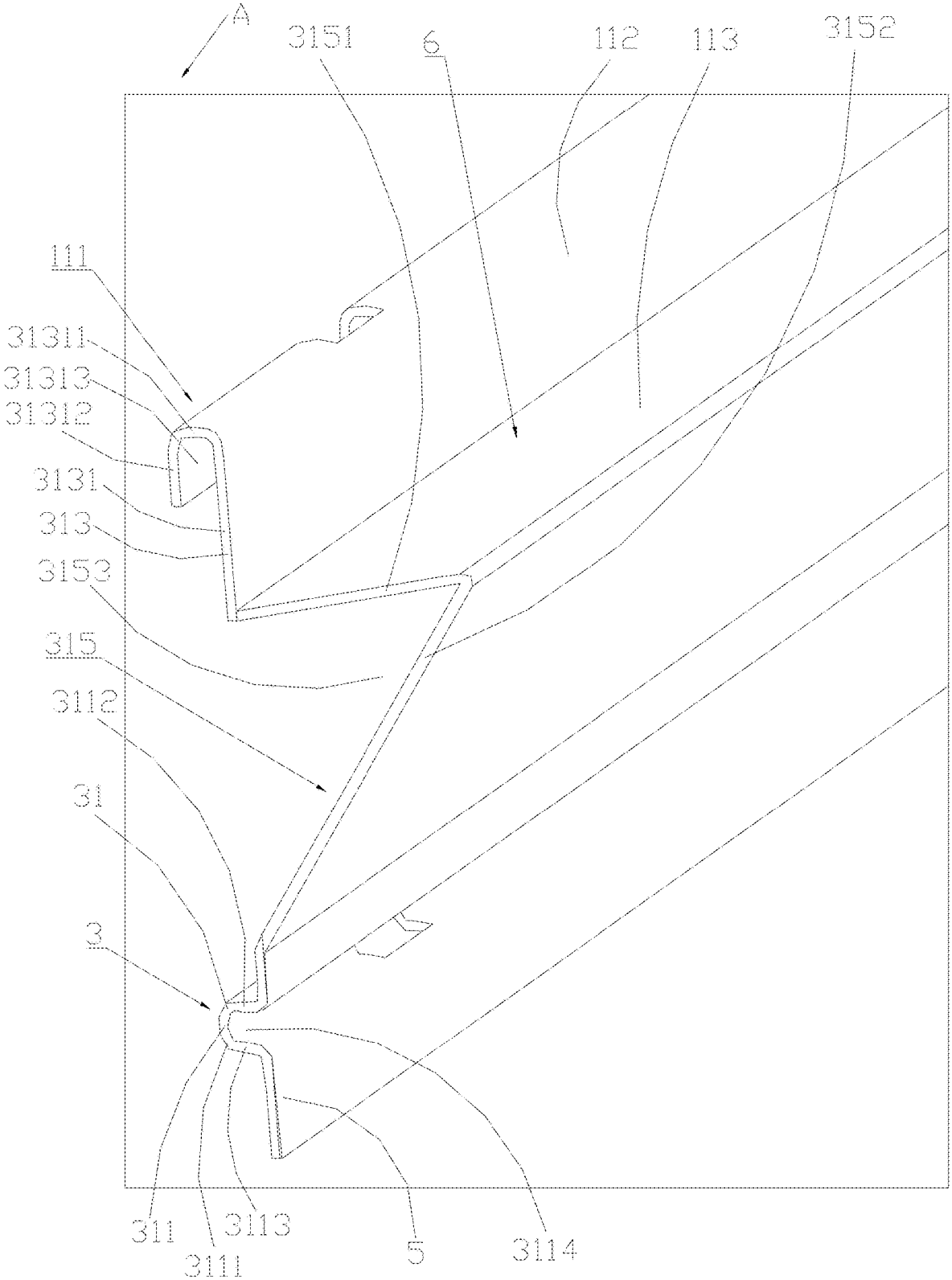
FIG. 3 is an enlarged view of area A in FIG. 2.
Figure 4:
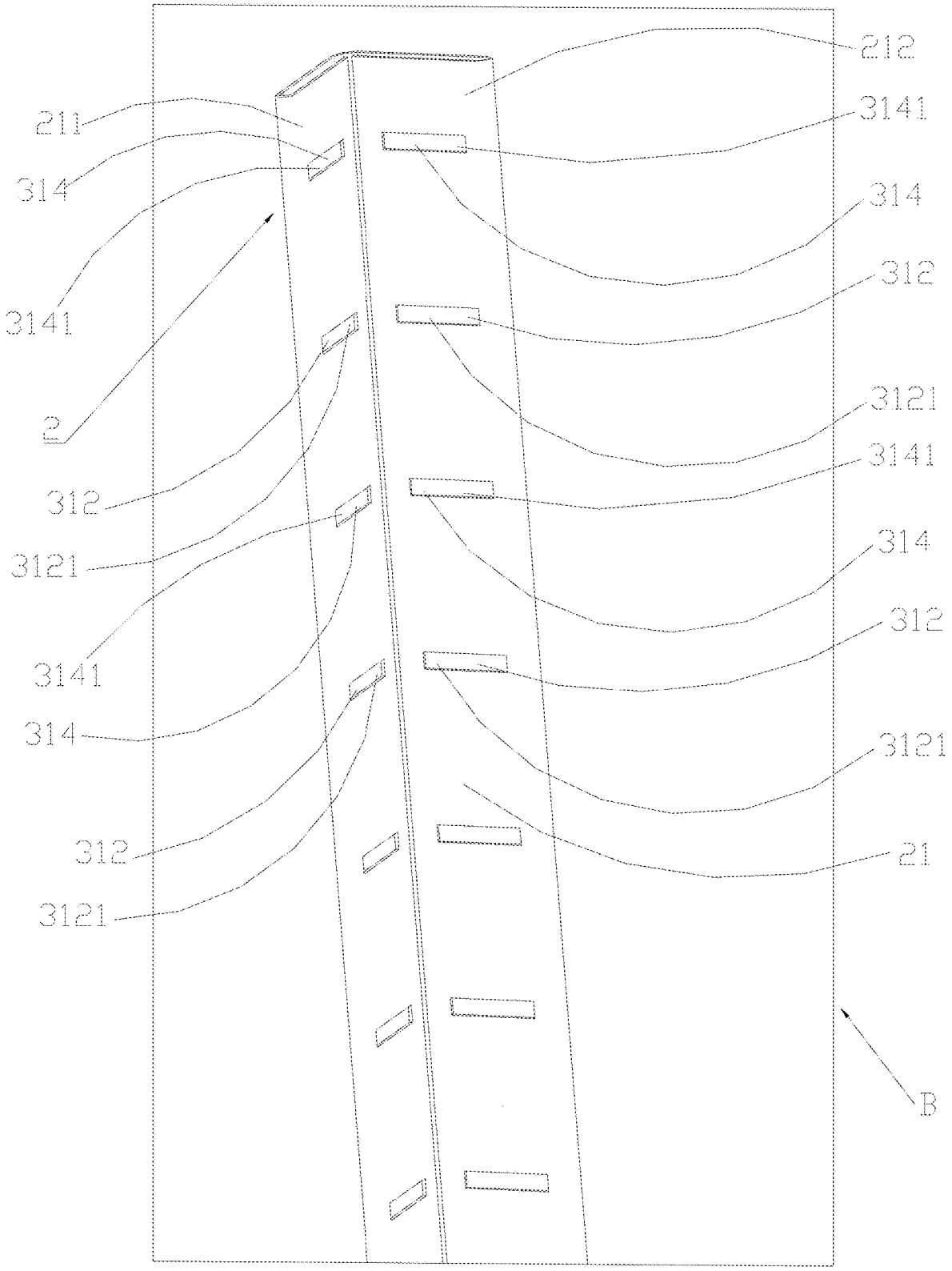
FIG. 4 is an enlarged view of area B in FIG. 2.
Figure 5:
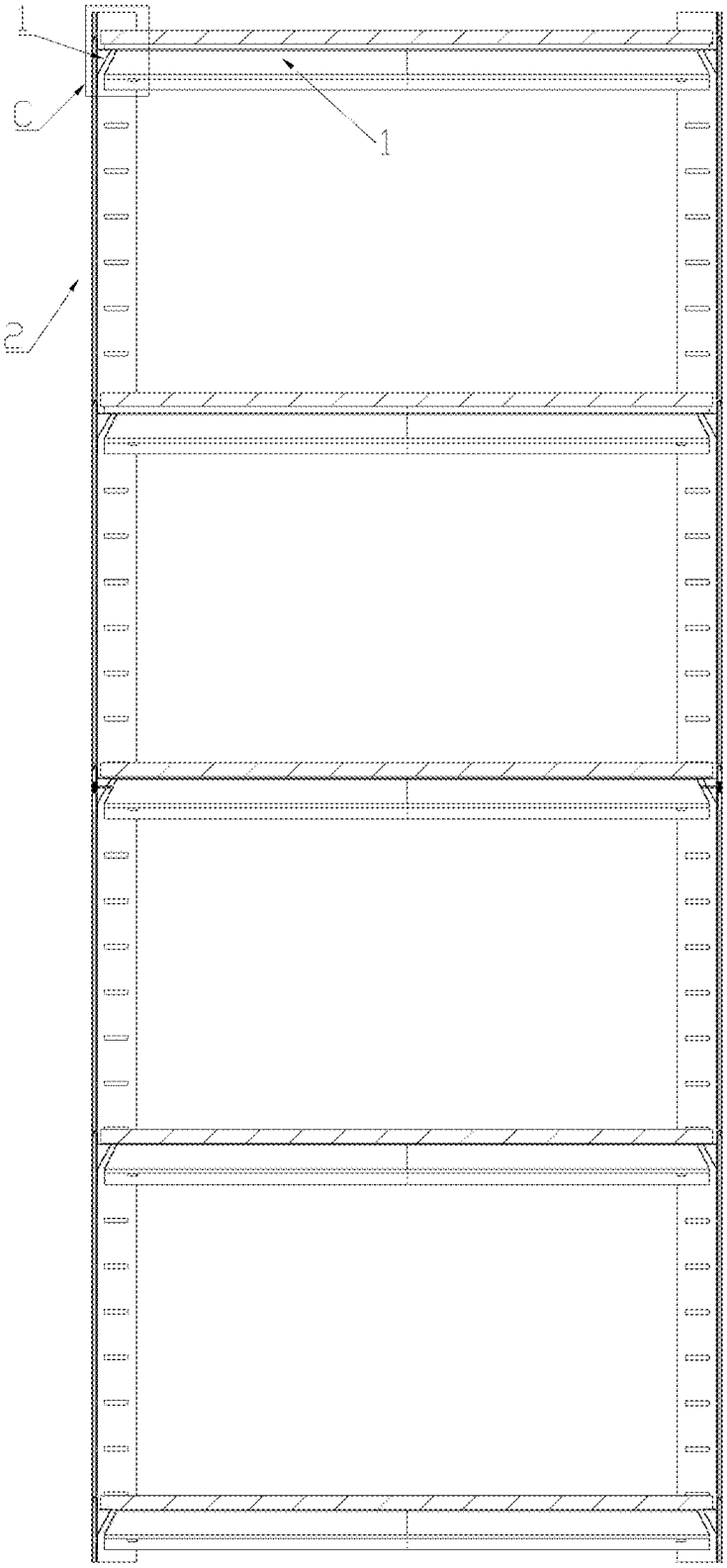
FIG. 5 is a sectional view taken along a first elastic wall and a first hook when a first locking portion is a first elastic wall and a second locking portion is a first hook.
Figure 6:
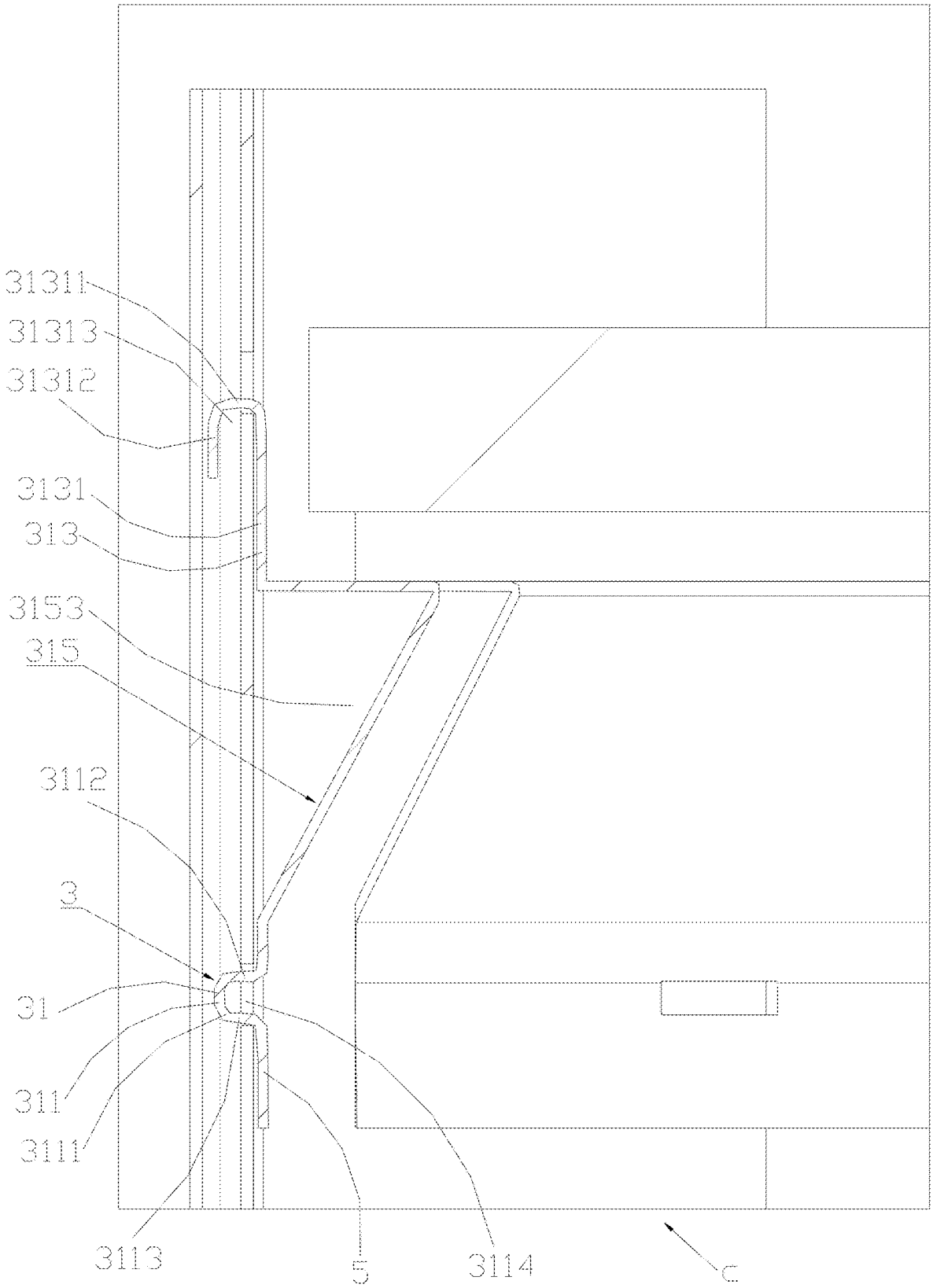
FIG. 6 is an enlarged view of area C in FIG. 5.
Figure 7:
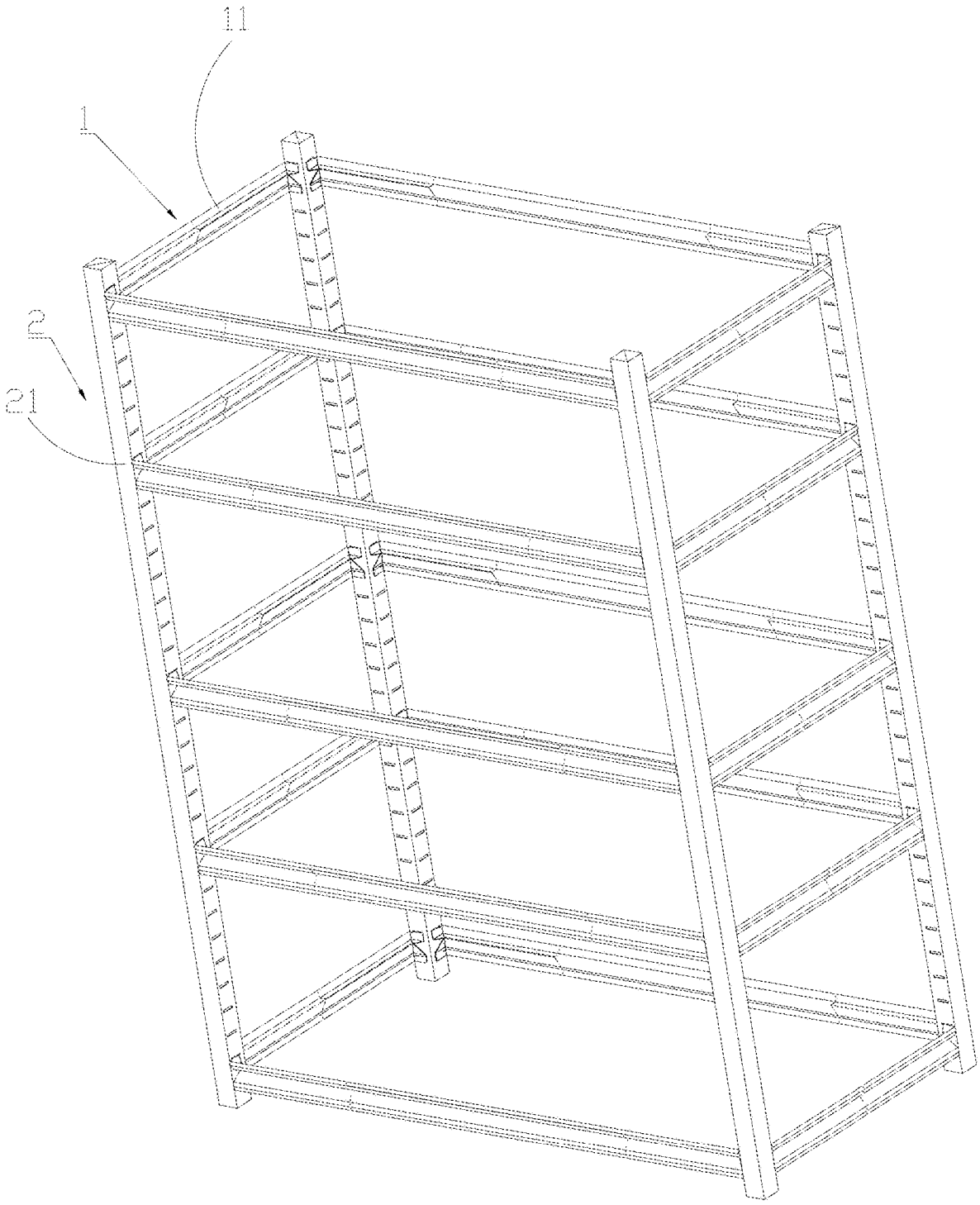
FIG. 7 is another schematic diagram of an overall structure of the present invention when a first locking portion is a first elastic wall and a second locking portion is a first hook.
Figure 8:
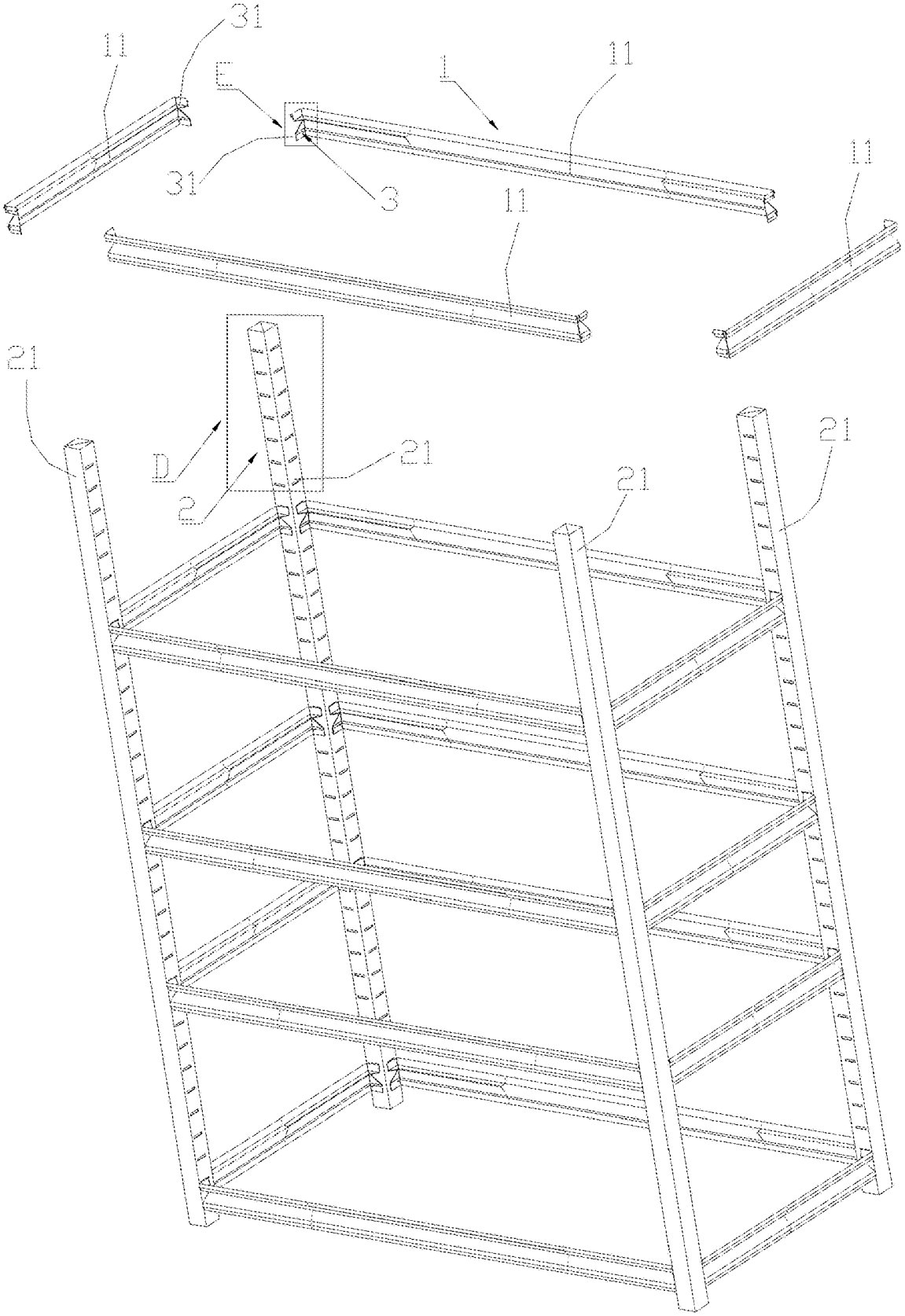
FIG. 8 is another exploded view of the present invention when a first locking portion is a first elastic wall and a second locking portion is a first hook.
Figure 9:
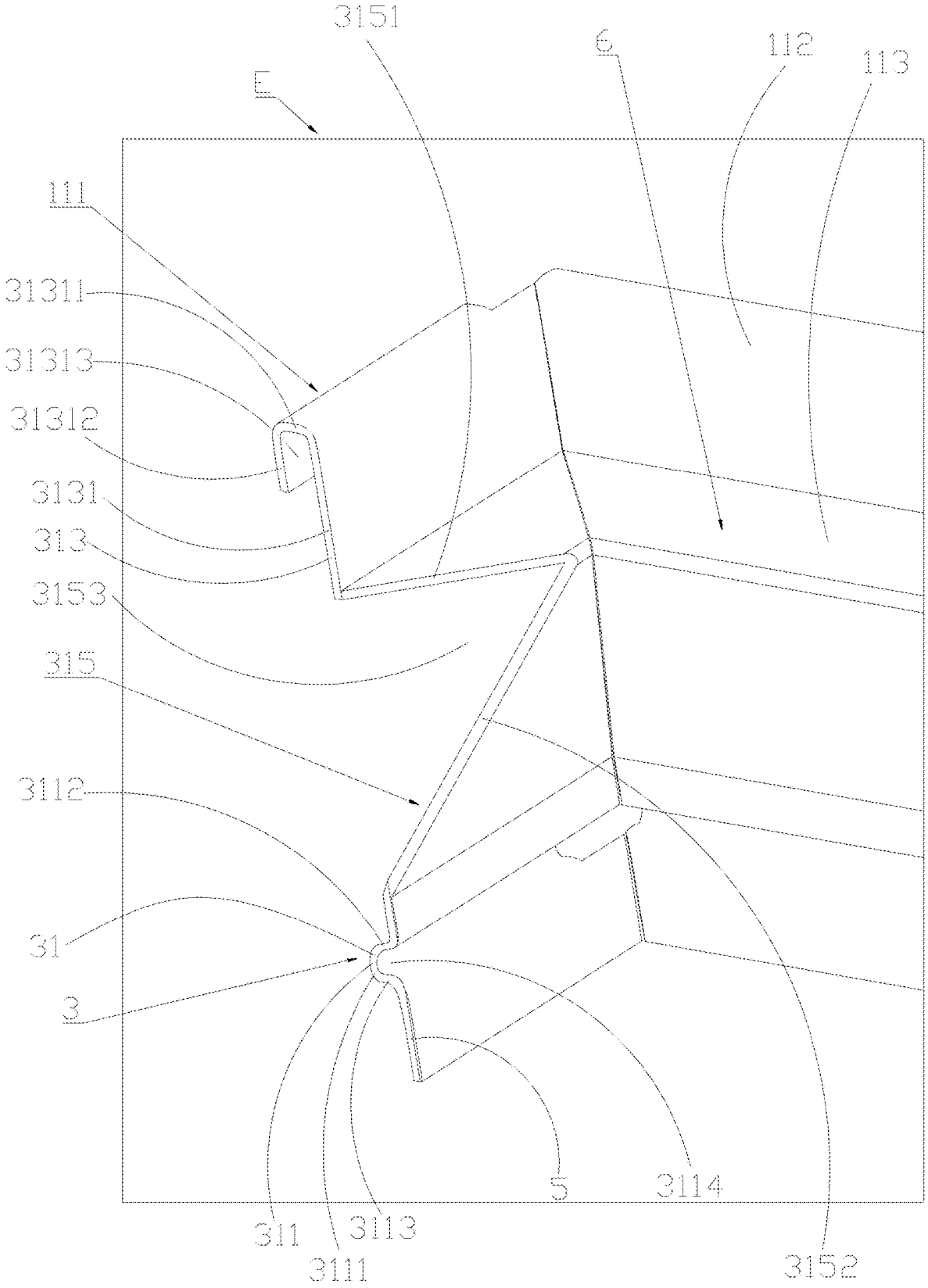
FIG. 9 is an enlarged view of area E in FIG. 8.
Figure 10:
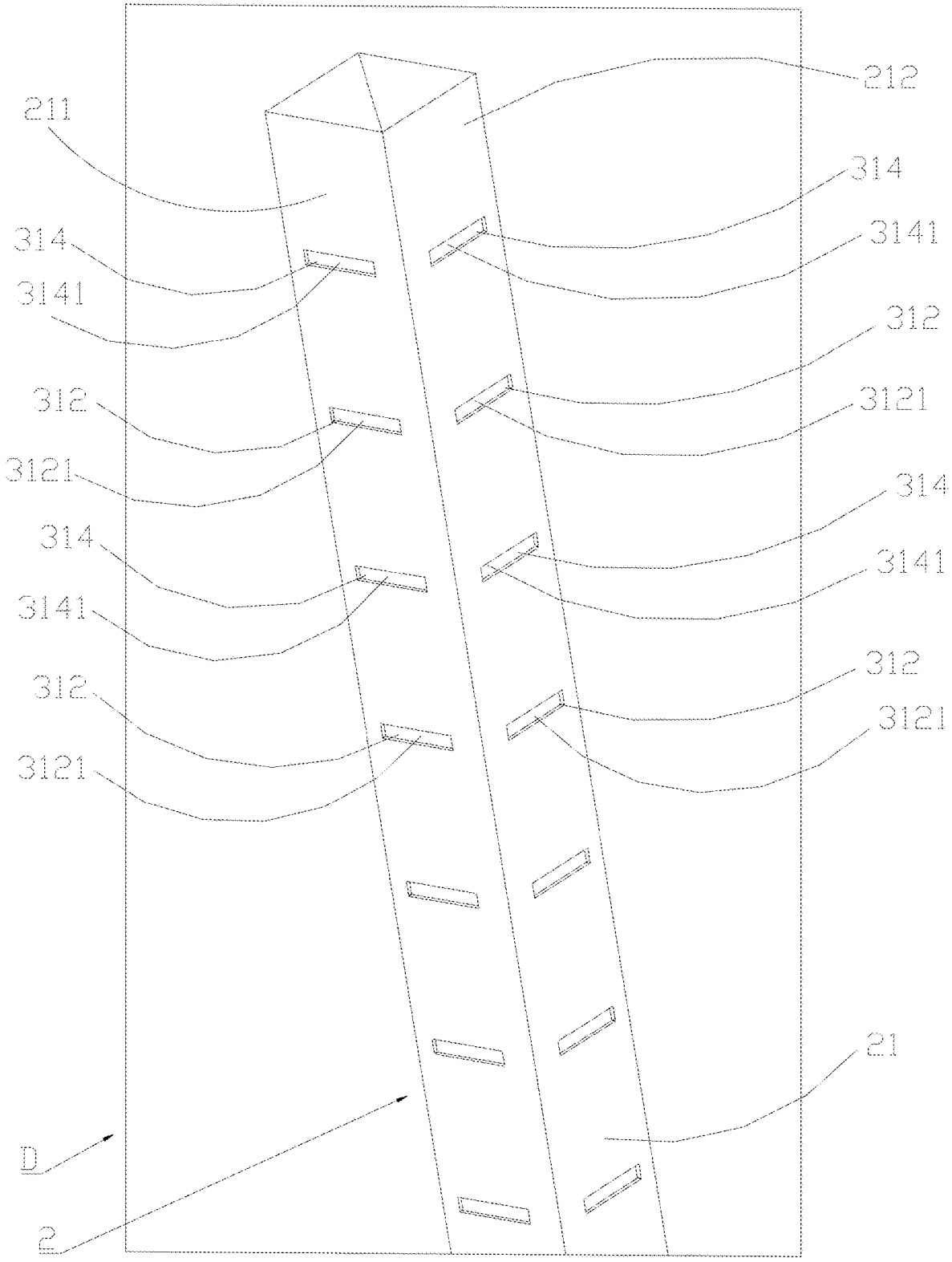
FIG. 10 is an enlarged view of area D in FIG. 8.
Figure 11:
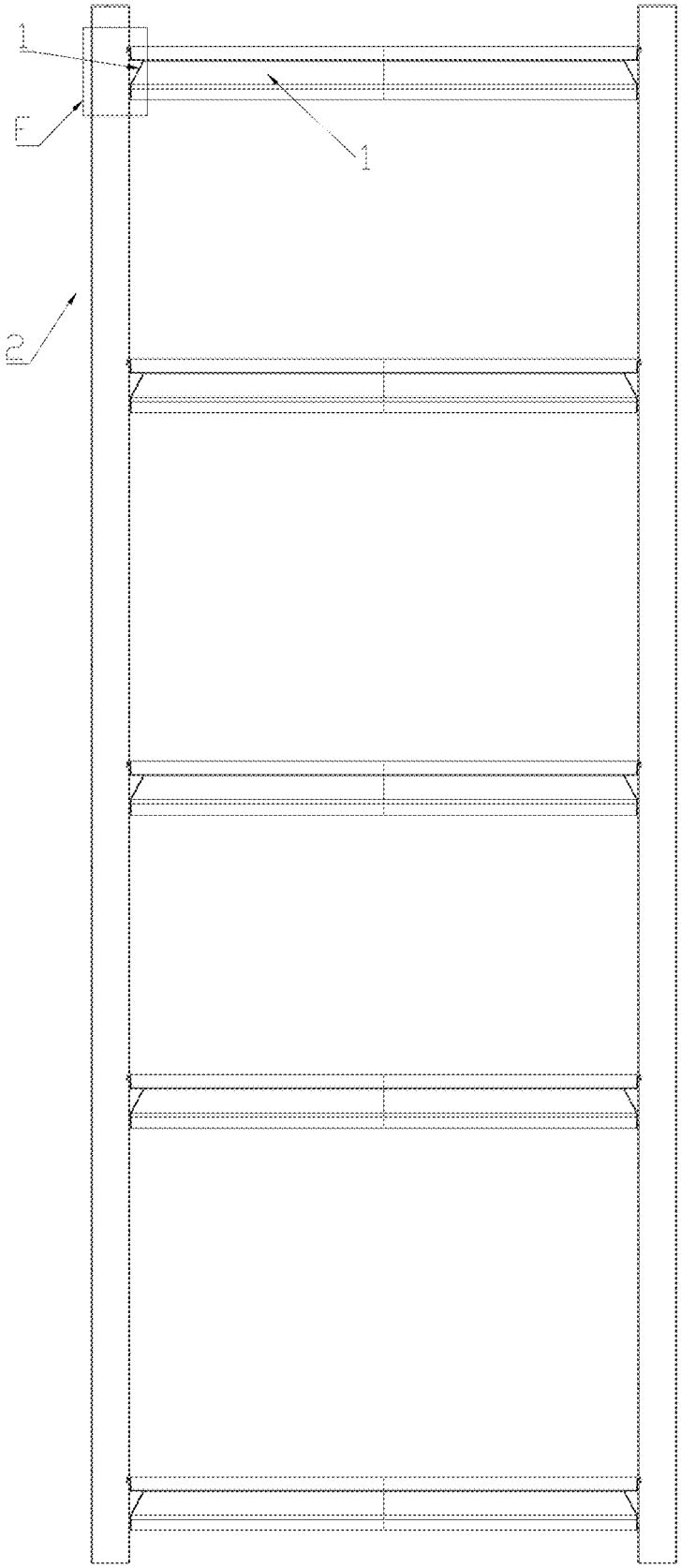
FIG. 11 is another sectional view taken along a first elastic wall and a first hook when a first locking portion is a first elastic wall and a second locking portion is a first hook.
Figure 12:
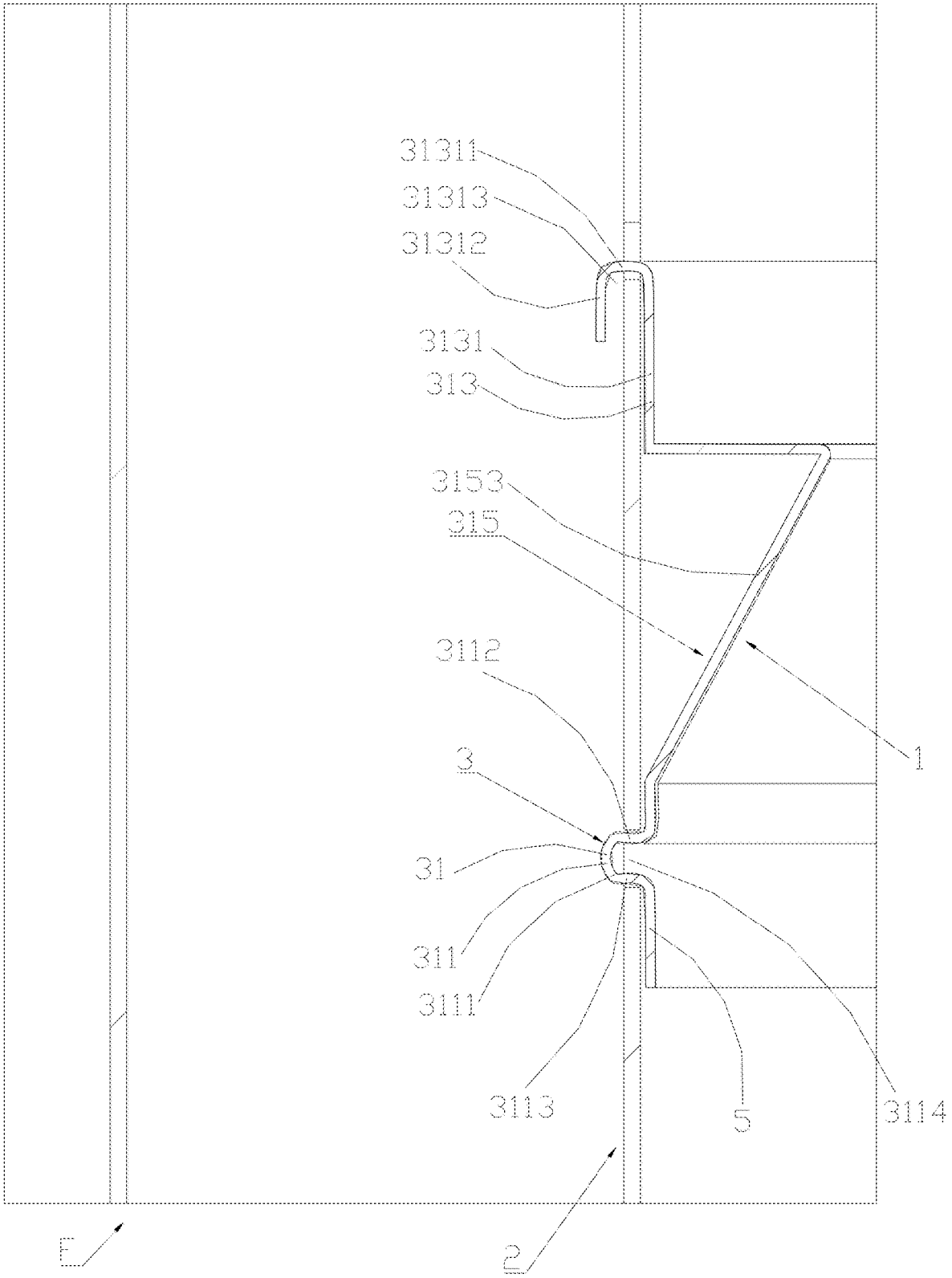
FIG. 12 is an enlarged view of area F in FIG. 11.
Figure 13:
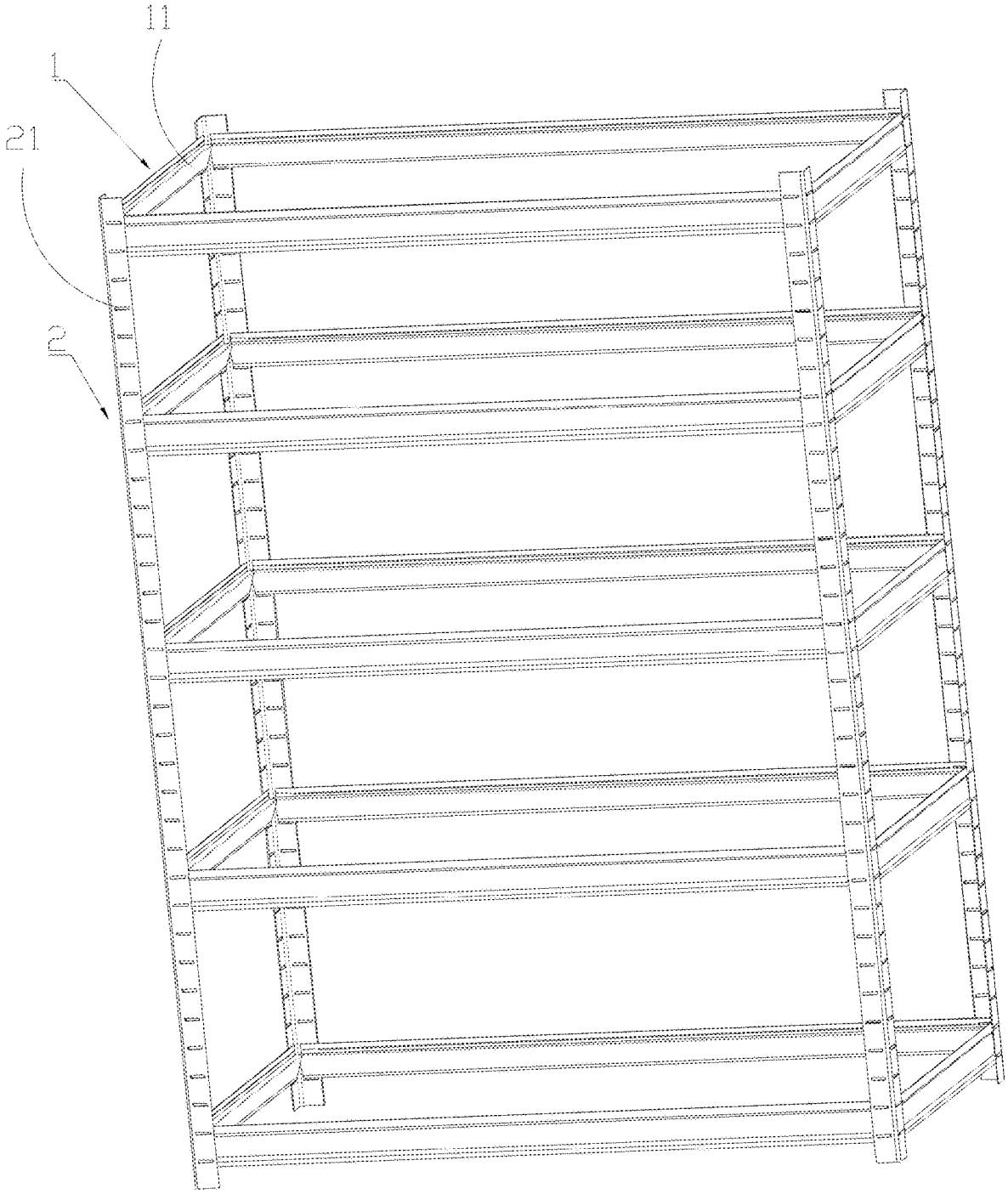
FIG. 13 is a schematic diagram of an overall structure of the present invention when a first locking portion is a first elastic wall and a second locking portion is a second elastic wall.
Figure 14:
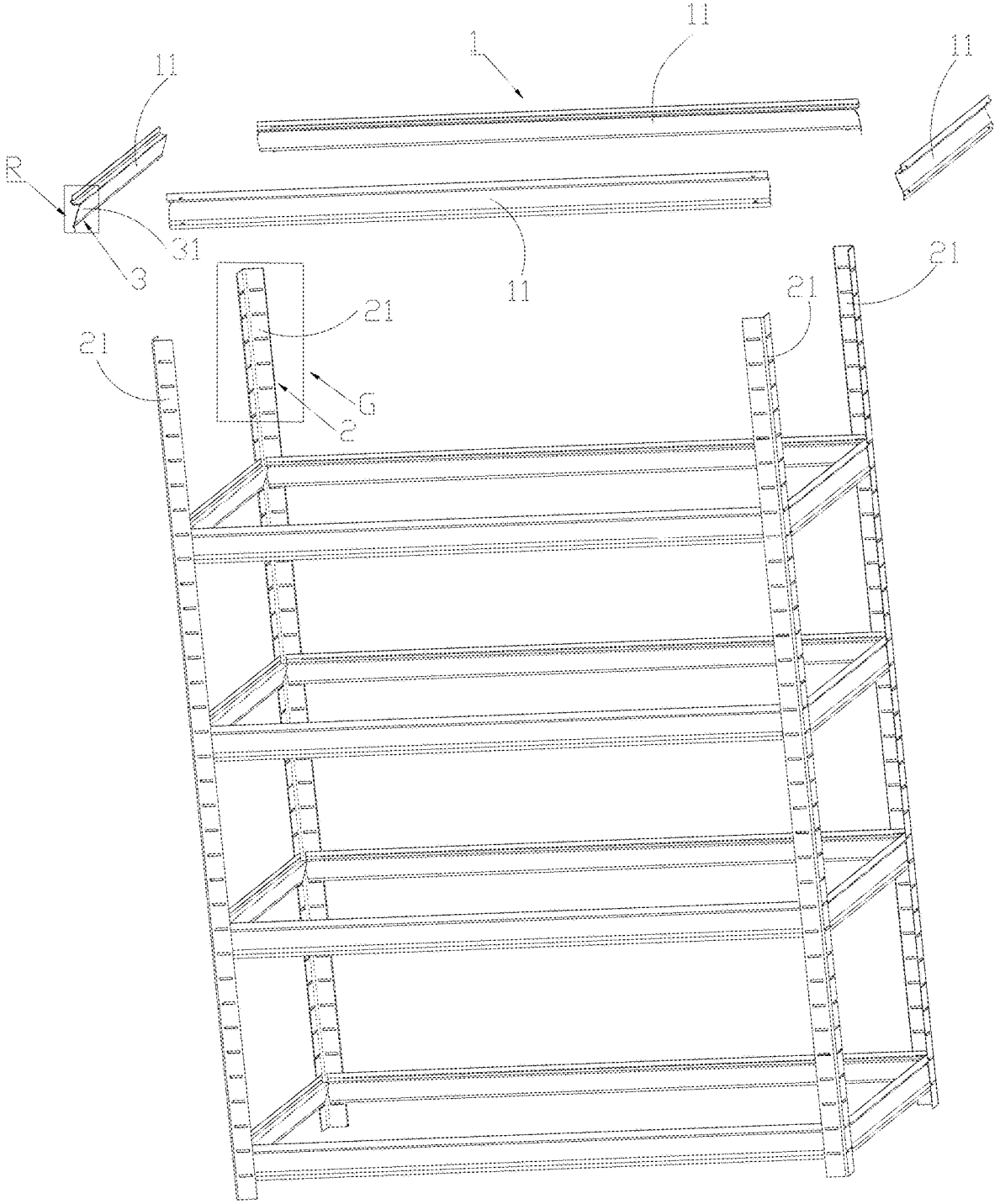
FIG. 14 is an exploded view of the present invention when a first locking portion is a first elastic wall and a second locking portion is a second elastic wall.
Figure 15:
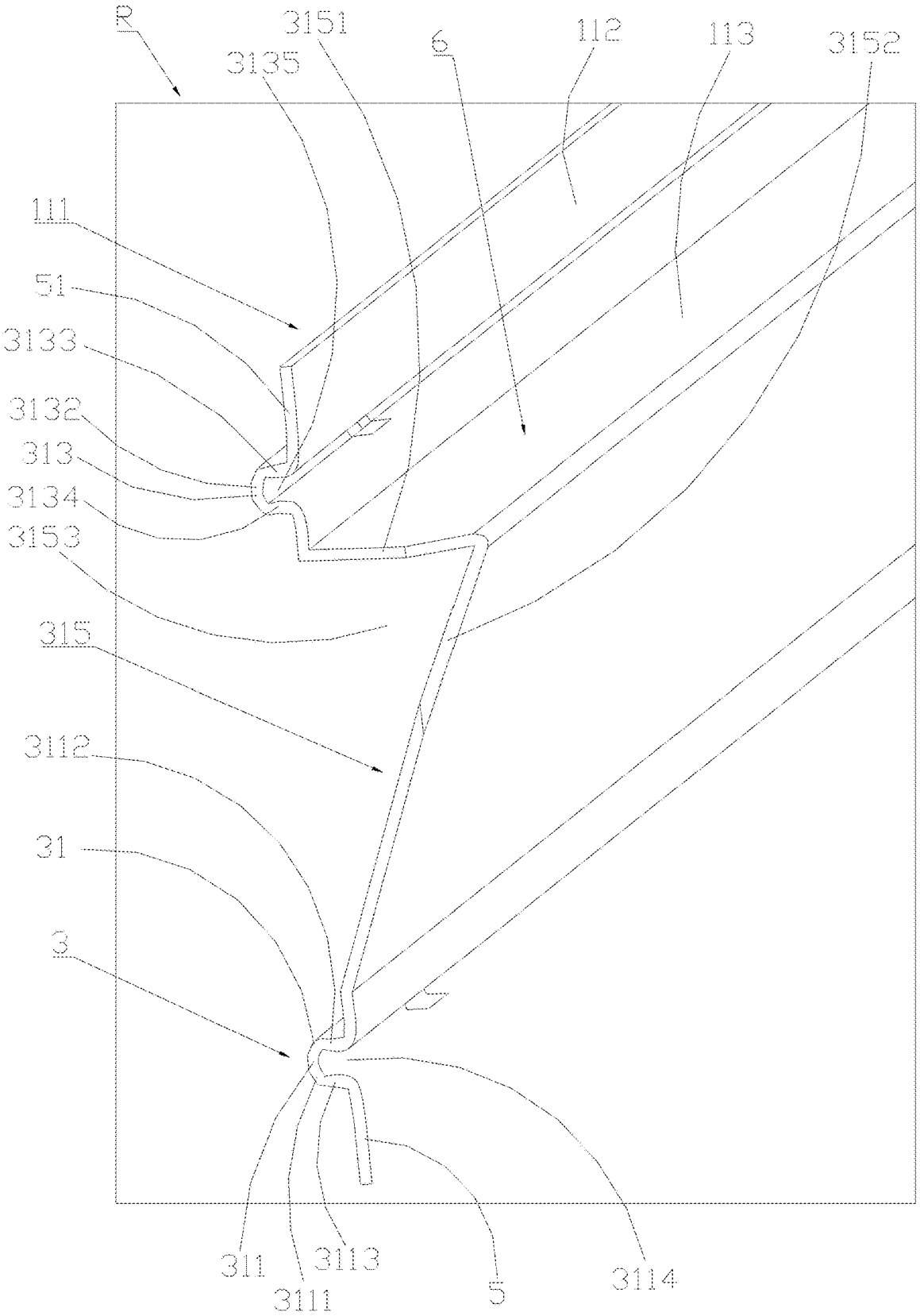
FIG. 15 is an enlarged view of area R in FIG. 14.
Figure 16:
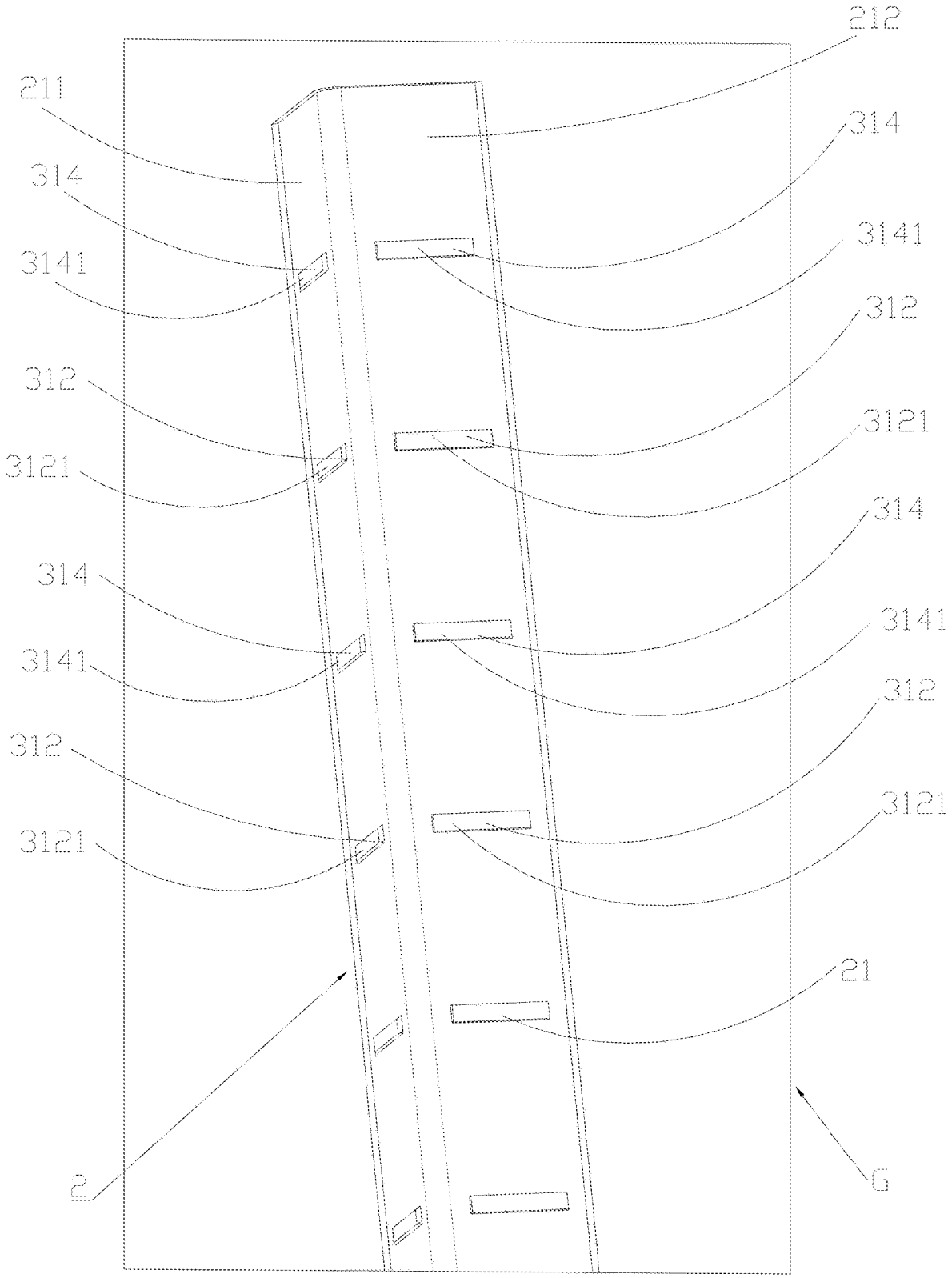
FIG. 16 is an enlarged view of area G in FIG. 14.
Figure 17:
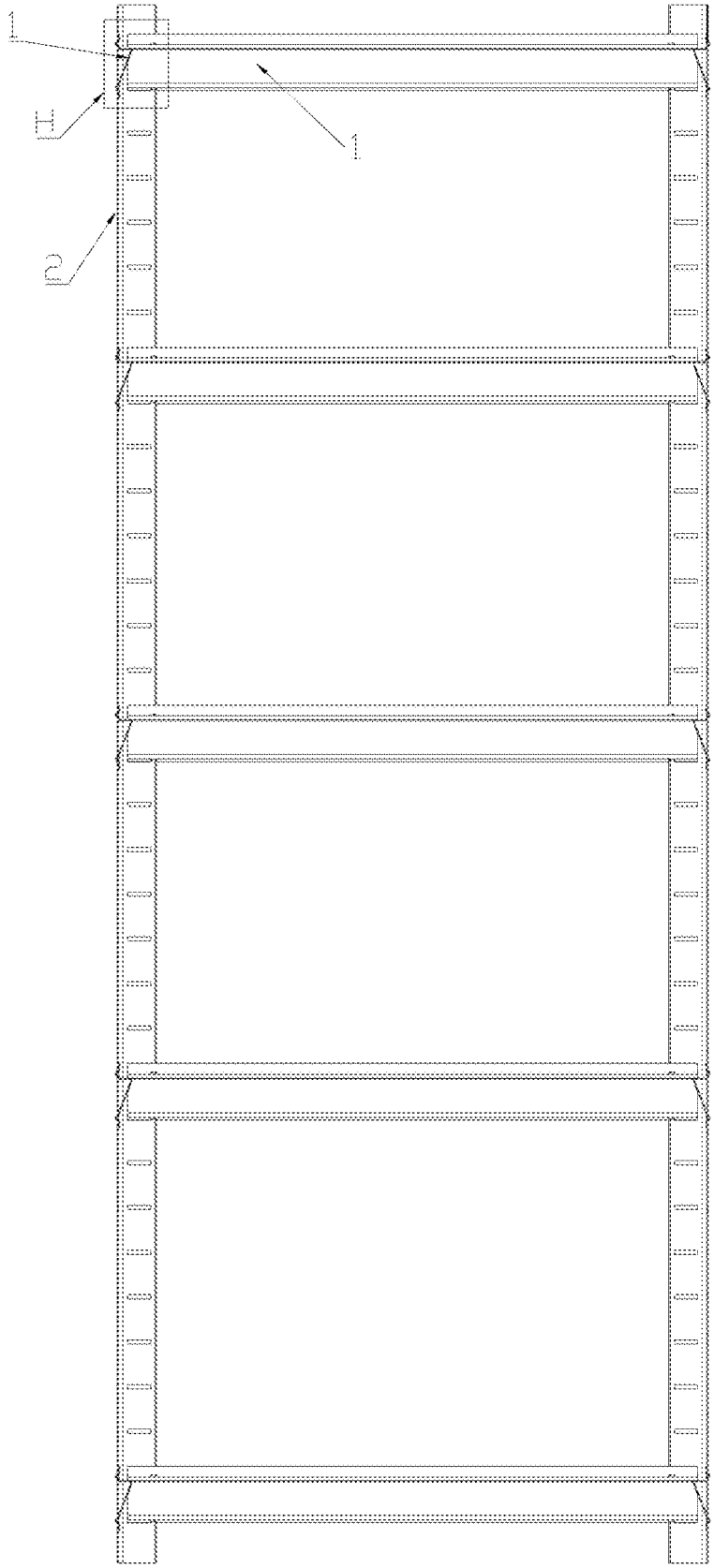
FIG. 17 is a sectional view taken along a first elastic wall and a second elastic wall when a first locking portion is a first elastic wall and a second locking portion is a second elastic wall.
Figure 18:
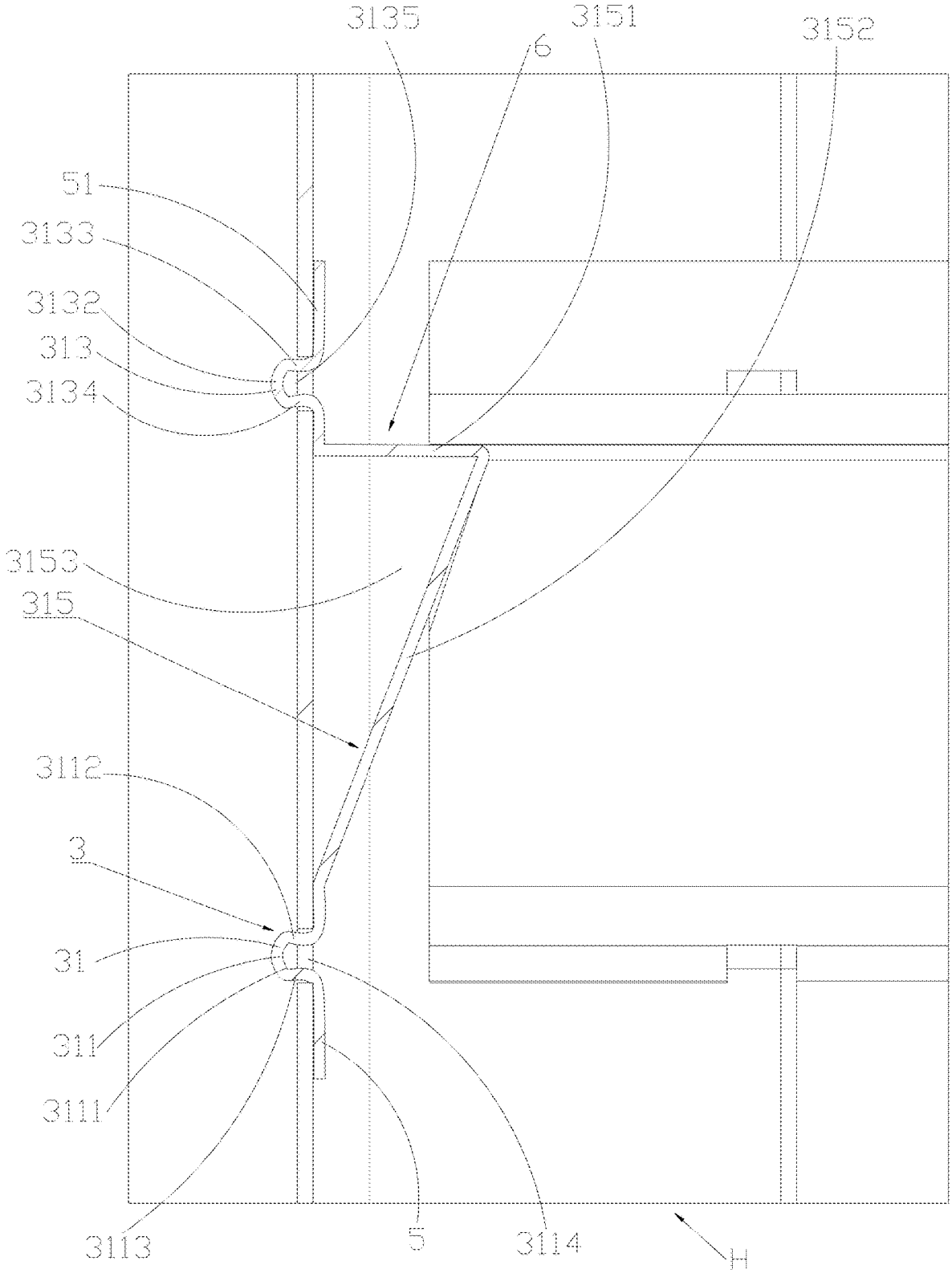
FIG. 18 is an enlarged view of area H in FIG. 17.
Figure 19:
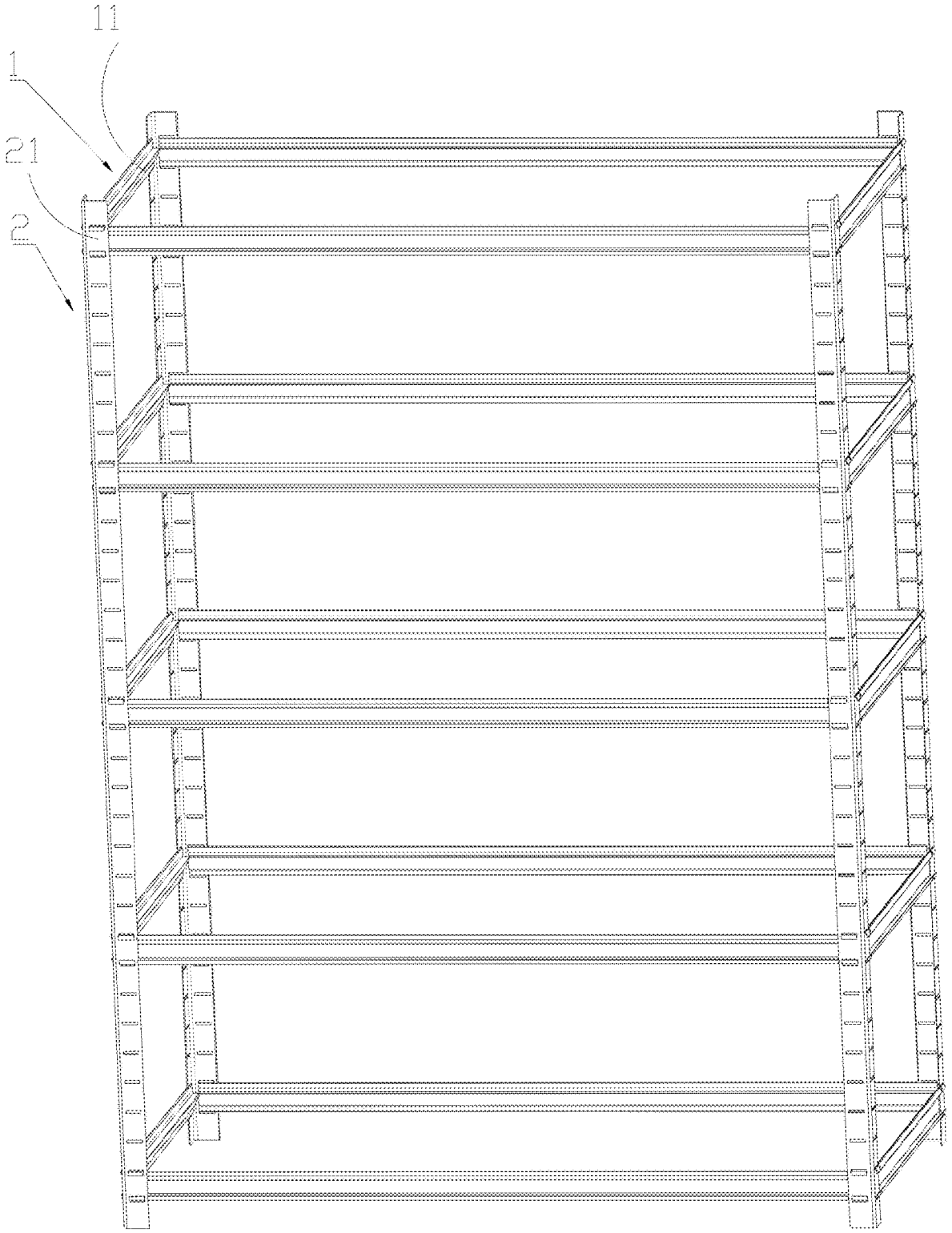
FIG. 19 is a schematic diagram of an overall structure of the present invention when a first locking portion is a second hook and a second locking portion is a first hook.
Figure 20:
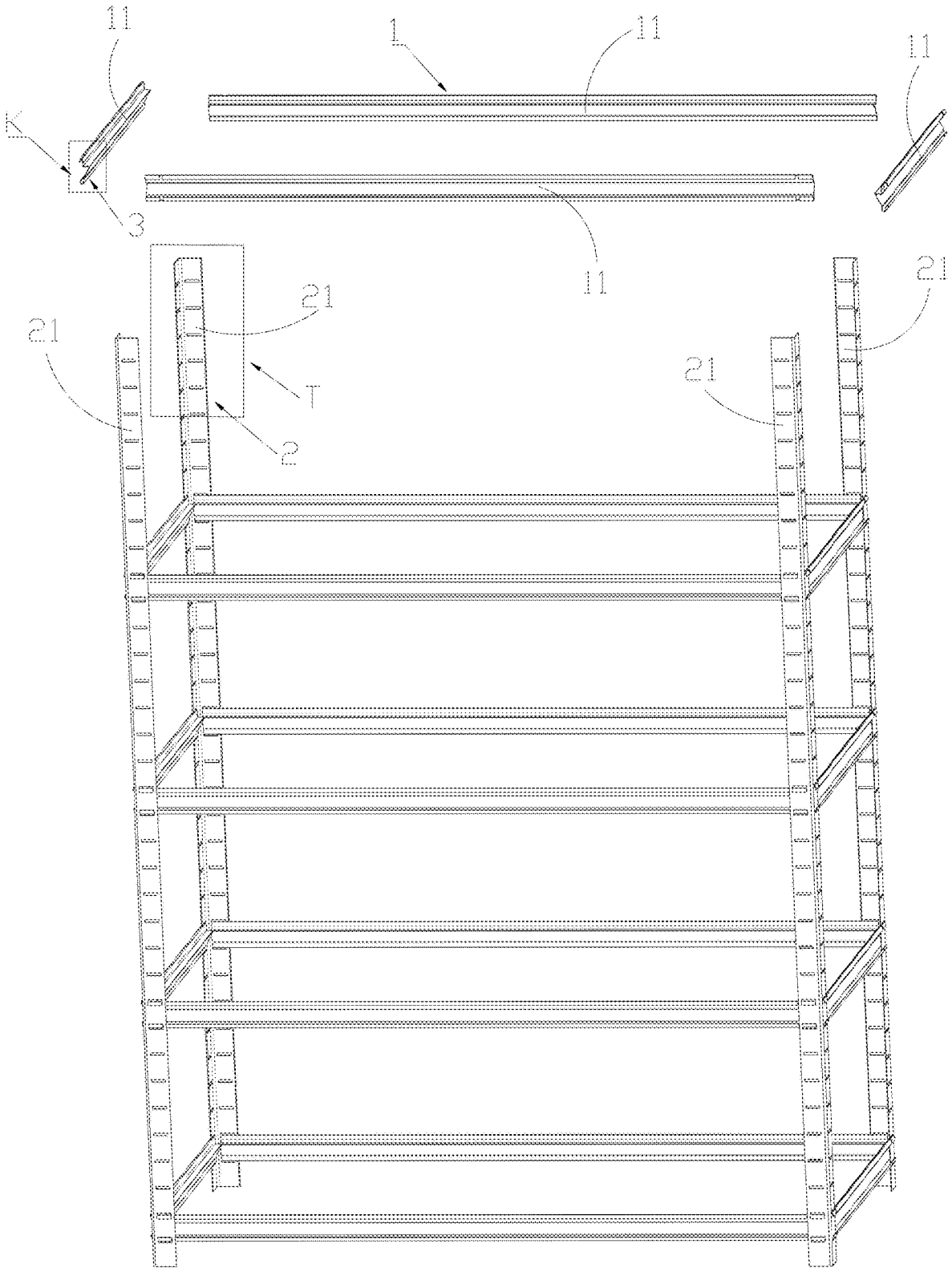
FIG. 20 is an exploded view of the present invention when a first locking portion is a second hook and a second locking portion is a first hook.
Figure 21:
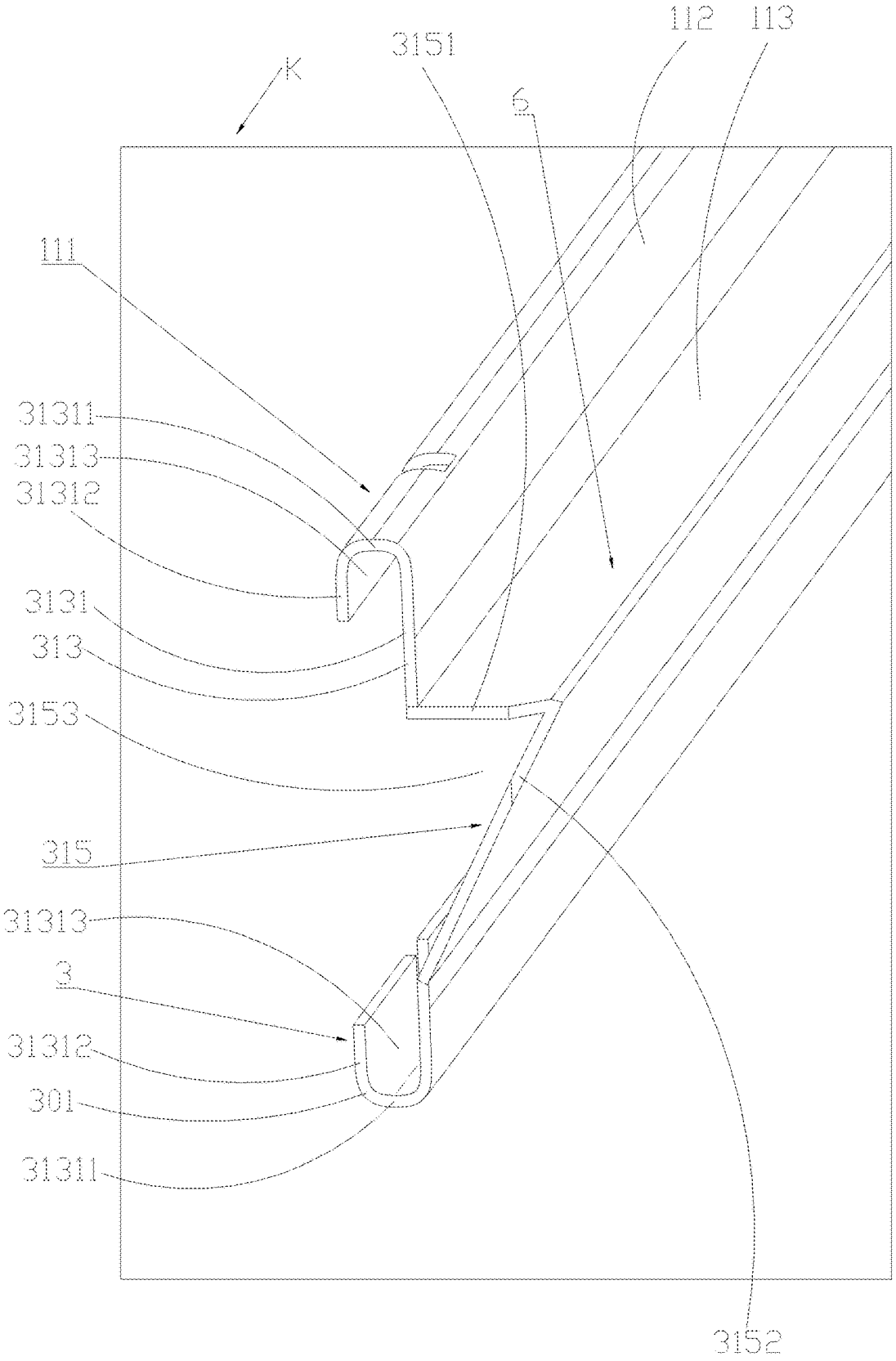
FIG. 21 is an enlarged view of area K in FIG. 20.
Figure 22:
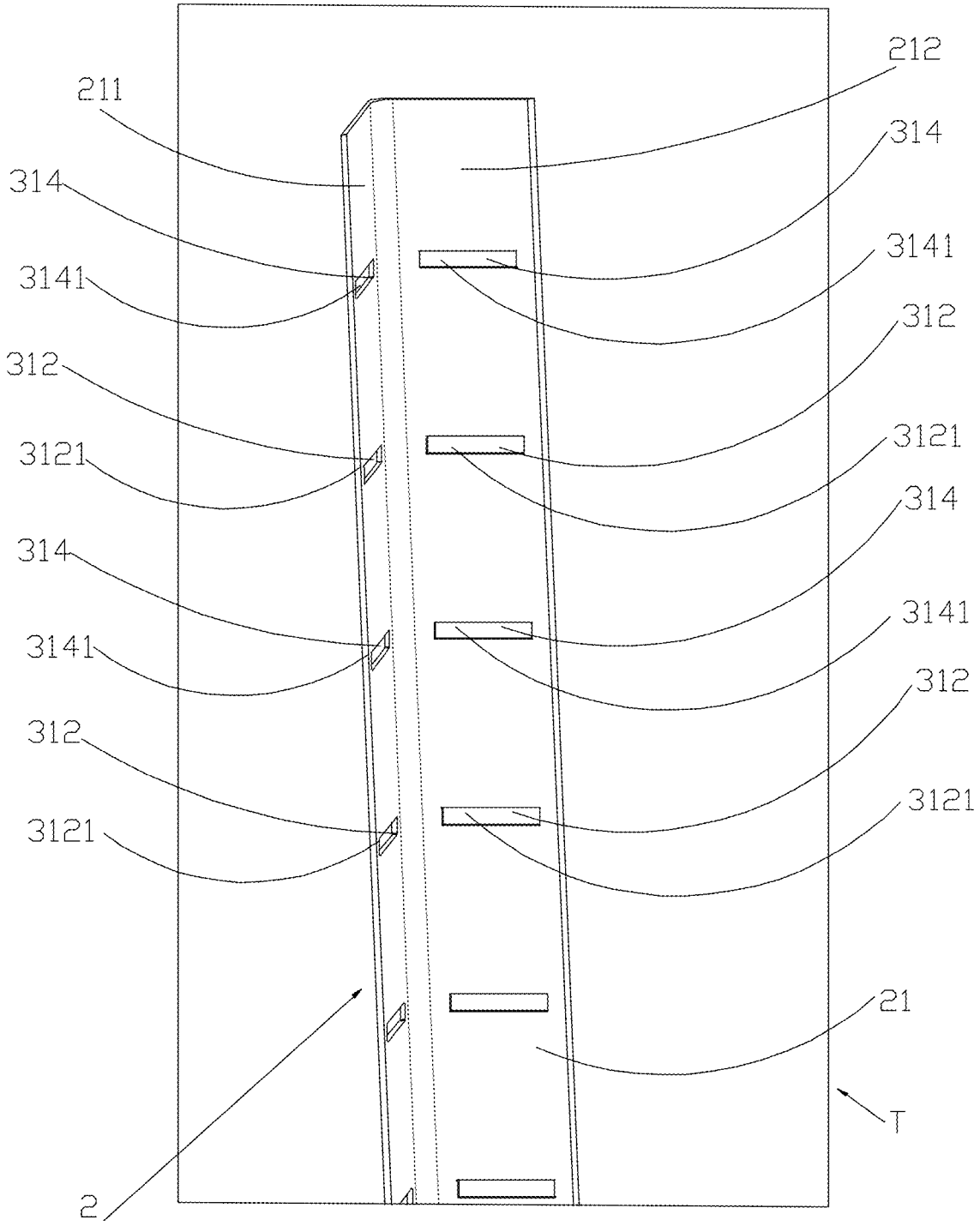
FIG. 22 is an enlarged view of area T in FIG. 20.
Figure 23:
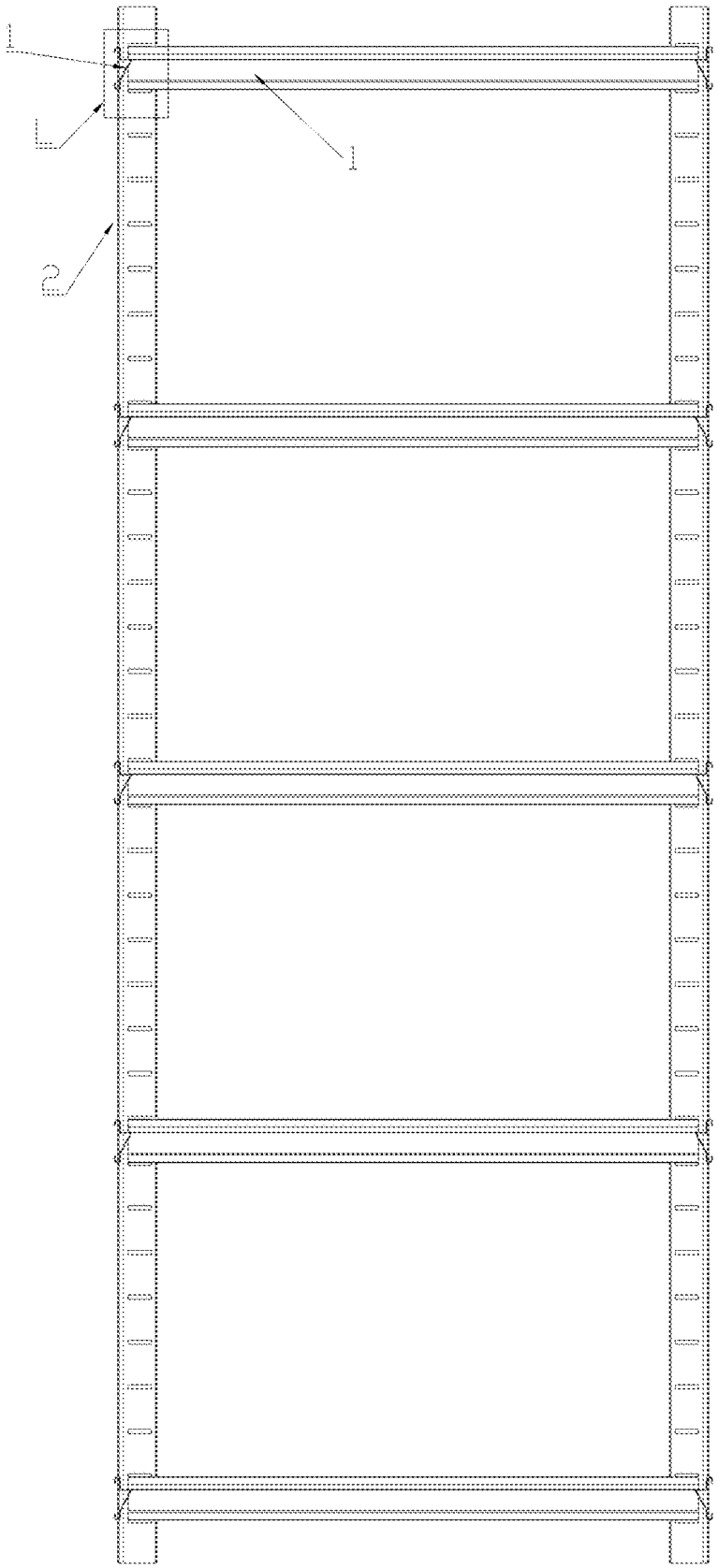
FIG. 23 is a sectional view taken along a second hook and a first hook when a first locking portion is a second hook and a second locking portion is a first hook.
Figure 24:
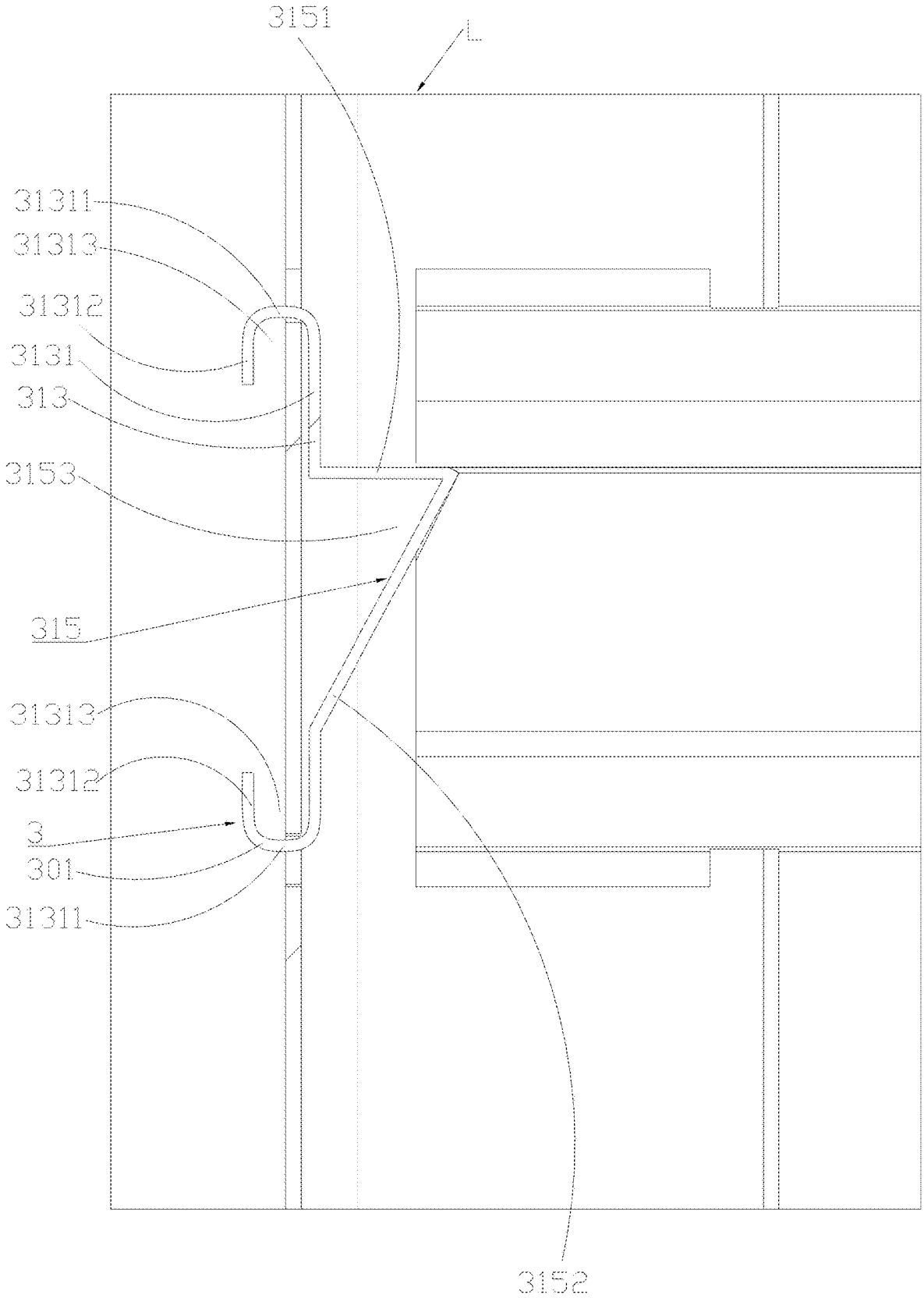
FIG. 24 is an enlarged view of area L in FIG. 23.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Referring to FIGS. 1-26, a shelf includes:

a support arm part 1;

a support foot part 2, wherein the support foot part 2 is used for supporting the support arm part 1; and a locking device 3, wherein the locking device 3 is used for detachably locking the support arm part 1 to the support foot part 2.

Through the above structure, the shelf includes the support arm part 1, the support foot part 2, and the locking device 3. The support foot part 2 is used for supporting the support arm part 1. The locking device 3 is used for detachably locking the support arm part 1 to the support foot part 2, so that the support arm part 1 and the support foot part 2 can be locked to each other through the locking part 31, making the installation and disassembly between the support arm part 1 and the support foot part 2 simpler and faster. Moreover, during the process of disassembling and assembling the support foot part 2 and the support arm part 1, only the locking of the support foot part and the support arm part by the locking device needs to be released, and the support foot part 2 and the support arm part 1 will not be damaged, so that the shelf can be repeatedly disassembled and assembled to meet needs of a user in different scenes. For example, it is convenient for the user to disassemble the shelf before transporting the shelf, and also convenient for the user to install the shelf again after transporting the shelf.

In this embodiment, the support foot part 2 is provided with a plurality of support feet 21. The support arm part 1 includes a plurality of support arms 11. The locking device 3 includes a plurality of locking parts 31. The support feet 21 and the support arms 11 are detachably connected through the locking parts 31, so that the plurality of support feet 21 and the plurality of support arms 11 are connected to each other and combined into a whole. Through the above structure, the support feet 21 and the support arms 11 are detachably connected by the locking parts 31, so that the plurality of support feet 21 and the plurality of support arms 11 are connected to each other and combined into a whole. All the support feet 21 and the support arms 11 of the shelf are detachably connected by the locking parts 31, facilitating the user to disassemble and assemble the shelf, and improving the efficiency of disassembly and assembly of the shelf.

In this embodiment, the support foot part 2 includes the support feet 21, the support arm part 1 includes the support arms 11, and the locking device 3 includes the locking parts 31. The locking part 31 includes a first locking portion 311 and a first locking fitting portion 312. The first locking portion 311 is provided on the support arm 11, and the first locking fitting portion 312 is provided on the support foot 21. The first locking portion 311 is connected to the first locking fitting portion 312 to lock the support arm 11 to the support foot 21. The first locking portion 311 is a first elastic wall 3111, the first locking fitting portion 312 is a first locking opening 3121, the first elastic wall 3111 is connected to the first locking opening 3121, and the first elastic wall 3111 is squeezed and locked onto an inner wall of the first locking opening 3121. Alternatively, the first locking fitting portion 312 is a first elastic wall 3111, the first locking portion 311 is a first locking opening 3121, the first elastic wall 3111 is connected to the first locking opening 3121, and the first elastic wall 3111 is squeezed and locked onto an inner wall of the first locking opening 3121. Specifically, the first elastic wall 3111 includes a protruding first side wall 3112 and a protruding second side wall 3113, the first side wall 3112 is connected to the second side wall 3113, the first side wall 3112 and the second side wall 3113 are arranged at an obtuse angle, an acute angle or a right angle, and a first elastic gap 3114 is defined between the first side wall 3112 and the second side wall 3113. Alternatively, the first elastic wall 3111 includes a protruding first side wall 3112 and a protruding second side wall 3113, the first side wall 3112 is connected to the second side wall 3113, and the first side wall and the second side wall abut against each other. Through the above structure, when the first elastic wall 3111 is inserted into and connected to the first locking opening 3121, the first elastic wall 3111 is squeezed within a range of the first elastic gap 3114. An elastic restoring force generated when the first elastic wall 3111 is squeezed pushes the first elastic wall 3111 to be squeezed and locked onto the inner wall of the first locking opening 3121, thereby squeezing and locking the support foot 21 to the support arm 11, and completing the installation between the support foot 21 and the support arm 11 simply and quickly. Moreover, when it is necessary to detach the support foot 21 from the support arm 11, only an external force greater than the elastic restoring force generated when the first elastic wall 3111 is squeezed needs to be applied to the first elastic wall 3111, which can push the first elastic wall 3111 out of the first locking opening 3121, so that the first elastic wall 3111 and the first locking opening 3121 can be separated from each other, and the support arm 11 can be detached from the support foot 21. During the process of removing the support arm 11 from the support foot 21, the structure of the support arm 11, the support foot 21, the first elastic wall 3111, and the first locking opening 3121 will not be damaged, which can facilitate the re-installation of the support arm 11 and the support foot 21, and allow the shelf to remain stable after the re-installation.

In this embodiment, the locking part 31 further includes a second locking portion 313 and a second locking fitting portion 314. The second locking portion 313 is provided on the support arm 11, and the second locking fitting portion 314 is provided on the support foot 21. The second locking portion 313 is connected to the second locking fitting portion 314 to lock the support arm 11 to the support foot 21. The locking part 31 also includes a first connecting side wall 315. The first locking portion 311 and the second locking portion 313 are connected by the first connecting side wall 315.

Referring to FIGS. 1-12, the second locking portion 313 is a first hook 3131, the second locking fitting portion 314 is a second locking opening 3141, the first hook 3131 is hung on the second locking opening 3141, and when the first elastic wall 3111 is connected to the first locking opening 3121, and the first elastic wall 3111 is squeezed and locked onto the inner wall of the first locking opening 3121, the first connecting side wall 315 tightens the first hook 3131 towards a direction of the first elastic wall 3111, so that the first connecting side wall 315 presses the first hook 3131 against an inner wall of the second locking opening 3141. Alternatively, the second locking fitting portion 314 is a first hook 3131, the second locking portion 313 is a second locking opening 3141, the first hook 3131 is hung on the second locking opening 3141, and when the first elastic wall 3111 is connected to the first locking opening 3121, and the first elastic wall 3111 is squeezed and locked onto the inner wall of the first locking opening 3121, the first connecting side wall 315 tightens the first hook 3131 towards a direction of the first elastic wall 3111, so that the first connecting side wall 315 presses the first hook 3131 against an inner wall of the second locking opening 3141. Through the above structure, when the first elastic wall 3111 is inserted into and connected to the first locking opening 3121, the first elastic wall 3111 is squeezed within the range of the first elastic gap 3114. The elastic restoring force generated when the first elastic wall 3111 is squeezed pushes the first elastic wall 3111 to be squeezed and locked onto the inner wall of the first locking opening 3121, thereby squeezing and locking the support foot 21 to the support arm 11, forming a first level locking between the support foot 21 and the support arm 11. The first hook 3131 is hung on the second locking opening 3141. When the first elastic wall 3111 is connected to the first locking opening 3121, and the first elastic wall 3111 is squeezed and locked onto the inner wall of the first locking opening 3121, the first connecting side wall 315 tightens the first hook 3131 towards the direction of the first elastic wall 3111, so that the first connecting side wall 315 presses the first hook 3131 against the inner wall of the second locking opening 3141, forming a second level locking between the support foot 21 and the support arm 11. The dual locking design makes the connection between the support arm 11 and the support foot 21 more stable, making the shelf less likely to loosen and safer. Moreover, the locking between the first elastic wall 3111 and the first locking opening 3121 can prevent upward and downward displacements between the support arm 11 and the support foot 21. At the same time, the first elastic wall 3111 is squeezed and locked onto the inner wall of the first locking opening 3121, which can prevent the first elastic wall 3111 from disengaging from the first locking opening 3121, and prevent leftward and rightward displacements between the support arm 11 and the support foot 21. The connection between the first hook 3131 and the second locking opening 3141 can further prevent the leftward and rightward displacements between the support arm 11 and the support foot 21, thereby strengthening the connection between the support arm and the support foot 21.

Referring to FIGS. 19-24, the locking part 31 further includes a second locking portion 313 and a second locking fitting portion 314. The second locking portion 313 is provided on the support arm 11, and the second locking fitting portion 314 is provided on the support foot 21. The second locking portion 313 is connected to the second locking fitting portion 314 to lock the support arm 11 to the support foot 21. The locking part 31 also includes a first connecting side wall 315, and the first locking portion 311 and the second locking portion 313 are connected by the first connecting side wall 315. The first locking portion 311 is a second hook 301, the first locking fitting portion 312 is a first locking opening 3121, and the first hook 301 is hung on the first locking opening 3121. Alternatively, the first locking fitting portion 312 is a second hook 301, the first locking portion 311 is a first locking opening 3121, and the first hook 301 is hung on the first locking opening 3121. Specifically, the second locking portion 313 is a first hook 3131, the second locking fitting portion 314 is a second locking opening 3141, and the first hook 3131 is hung on the second locking opening 3141; when the second hook 301 is hung on the first locking opening 3121, and the first hook 3131 is hung on the second locking opening 3141, the first connecting side wall tightens the first hook and the second hook to each other, so that the first hook 3131 is pressed against an inner wall of the second locking opening 3141, and the second hook 301 is pressed against an inner wall of the first locking opening 3121. Alternatively, the second locking fitting part 314 is a first hook 3131, the second locking portion 313 is a second locking opening 3141, and the first hook 3131 is hung on the second locking opening 3141; when the second hook 301 is hung on the first locking opening 3121, and the first hook 3131 is hung on the second locking opening 3141, the first connecting side wall tightens the first hook and the second hook to each other, so that the first hook 3131 is pressed against an inner wall of the second locking opening 3141, and the second hook 301 is pressed against an inner wall of the first locking opening 3121. The first hook, the second hook, or the first connecting side wall has elasticity. Through the above structure, a distance between the first hook and the second hook is smaller than a distance between the first locking opening and the second locking opening, so that when the first hook is connected to the second locking opening, and the second hook is connected to the first locking opening, the first hook and the second hook are elastically tightened against each other. Specifically, the first hook extends towards the second hook, and the second hook extends towards the first hook.

Referring to FIGS. 13-18, the second locking portion 313 is a second elastic wall 3132, the second locking fitting portion 314 is a second locking opening 3141, the second elastic wall 3132 is connected to the second locking opening 3141, and the second elastic wall 3132 is squeezed and locked onto an inner wall of the second locking opening 3141. Alternatively, the second locking fitting portion 314 is a second elastic wall 3132, the second locking portion 313 is a second locking opening 3141, the second elastic wall 3132 is connected to the second locking opening 3141, and the second elastic wall 3132 is squeezed and locked onto an inner wall of the second locking opening 3141. The second elastic wall 3132 includes a protruding third side wall 3133 and a protruding fourth side wall 3134, the third side wall 3133 is connected to the fourth side wall 3134, the third side wall 3133 and the fourth side wall 3134 are arranged at an obtuse angle, an acute angle or a right angle, and a second elastic gap 3135 is defined between the third side wall 3133 and the fourth side wall 3134. Alternatively, the second elastic wall 3132 includes a protruding third side wall 3133 and a protruding fourth side wall 3134, the third side wall 3133 is connected to the fourth side wall 3134, and the third side wall and the fourth side wall abut against each other. Through the above structure, when the first elastic wall 3111 is inserted into and connected to the first locking opening 3121, the first elastic wall 3111 is squeezed within a range of the first elastic gap 3114, an elastic restoring force generated when the first elastic wall 3111 is squeezed pushes the first elastic wall 3111 to be squeezed and locked onto an inner wall of the first locking opening 3121, thereby squeezing and locking the support foot 21 to the support arm 11, forming a first level locking between the support foot 21 and the support arm 11. When the second elastic wall 3132 is inserted into and connected to the second locking opening 3141, the second elastic wall 3132 is squeezed within a range of the second elastic gap 3135, and an elastic restoring force generated when the second elastic wall 3132 is squeezed pushes the second elastic wall 3132 to be squeezed and locked onto an inner wall of the second locking opening 3141, thereby squeezing and locking the support foot 21 to the support arm 11, forming a second level locking between the support foot 21 and the support arm 11. The dual locking design makes the connection between the support arm 11 and the support foot 21 more stable, making the shelf less likely to loosen and safer.

In this embodiment, the locking part 31 further includes a first connecting side wall 315. The first connecting side wall 315 is an elastic first connecting side wall 315. The first locking portion 311 and the second locking portion 313 are connected by the first connecting side wall 315. The first connecting side wall 315 includes a first connecting wall 3151 and a second connecting wall 3152. The first connecting wall 3151 is connected to the first locking portion 311. The second connecting wall 3152 is connected to the second locking portion 313. The first connecting wall 3151 is connected to the second connecting wall 3152. The first connecting wall 3151 and the second connecting wall 3152 are arranged at an obtuse angle, an acute angle or a right angle. A third elastic gap 3153 is defined between the first connecting wall 3151 and the second connecting wall 3152. Through the above structure, due to the third elastic gap 3153 defined between the first connecting wall 3151 and the second connecting wall 3152, the first connecting wall 3151 and the second connecting wall 3152 can approach or move away from each other within a range of the third elastic gap 3153, so that the first connecting side wall 315 can be compressed or stretched. When the first locking portion 311 is connected to the first locking fitting portion 312, the first connecting side wall 315 is stretched, and an elastic restoring force generated when the first connecting side wall 315 is stretched can tighten the first locking portion 311 and the second locking portion 313 to each other, so that the first elastic wall 3111 is further squeezed and locked onto the inner wall of the first locking opening 3121, and the second elastic wall 3132 or the first hook 3131 is further squeezed and locked onto the inner wall of the second locking opening 3141.

In this embodiment, the support arm 11 is provided with first connecting part 111, a first extension part 112, and a support part 113. Two ends of the first extension part 112 are each connected to one of the first connecting parts 111. The first locking portion 311 is provided on the first connecting part 111. The support part 113 is used for supporting a storage board 4. The support part 113 extends from the first extension part 112 and/or the first connecting part 111. The first connecting part 111 and the first extension part 112 are integrally formed and connected; alternatively, the first connecting part 111 and the first extension part 112 are detachably connected; alternatively, the first connecting part 111 and the first extension part 112 are fixedly connected. Specifically, the first connecting part 111, the first extension part 112, and the support part 113 are integrally formed and connected. Through the above structure, since the first connecting part 111, the first extension part 112, and the support part 113 are integrally formed and connected, the overall strength of the support arm 11 is higher. Moreover, the support part 113 supports the storage board 4, facilitating the installation of the storage board 4 and allowing a user to place items on the storage board 4. The support part 113 is provided between a top portion and a bottom portion of the first extension part 112 and/or a top portion and a bottom portion the first connecting part 111, so that an accommodating groove 6 for receiving the storage board 4 is formed between the support part 113 and the first extension part 112 and/or the first connecting part 111.

In this embodiment, the support foot 21 includes a first support side wall 211 and a second support side wall 212. The first support side wall 211 is connected to the second support side wall 212, and the first support side wall 211 and the second support side wall 212 are arranged at an obtuse angle, a right angle or an acute angle. The first support side wall 211 and the second support side wall 212 are both equipped with first locking fitting portions 312. Through the above structure, both the first support side wall 211 and the second support side wall 212 are provided with the first locking fitting portions 312 connected to the first locking portion 311 of the support arm 11, so that both the first support side wall 211 and the second support side wall 212 can be connected to the support arm 11. Moreover, since the first support side wall 211 and the second support side wall 212 are arranged at an obtuse angle, a right angle or an acute angle, the support arm 11 connected to the first support side wall 211 and the support arm connected to the second support side wall 212 extend towards different directions, so that the plurality of support arms 11 and the plurality of support feet 21 are connected to each other and then surround and form the shelf.

In this embodiment, the support foot 21 is an L-shaped support foot 21, a square support foot 21, a polygonal support foot 21, or a circular support foot 21. Through the above structure, the support foot 21 with a variety of optional shapes can meet the usage needs of the user in different scenes. Referring to FIGS. 1-6, the support foot 21 is an L-shaped support foot 21. An inner side of the first support side wall 211 and an inner side of the second support side wall 212 are provided with first locking fitting portions 312. The first locking portion 311 is provided on an inner side of the support arm 11, so that the first connecting part 111 abuts against the first support side wall 211 or the second support side wall 212, and the first locking portion 311 is capable of being connected to the first locking fitting portion 312. The support foot 21 is an L-shaped support foot 21, and the first connecting part 111 and the first extension part 112 extend in an identical direction, so that the first connecting part 111 is capable of abutting against the inner side of the first support side wall 211 or the inner side of the second support side wall 212, and the first locking portion 311 is capable of being connected to the first locking fitting portion 312. Alternatively, referring to FIGS. 7-12, the support foot 21 is a square support foot 21. An outer side of the first support side wall 211 and an outer side of the second support side wall 212 are provided with first locking fitting portions 312. The first locking portion 311 is provided on an outer side of the support arm 11. The first connecting part 111 and the first extension part 112 are arranged at an obtuse angle, a right angle or an acute angle, so that the first connecting part 111 abuts against the first support side wall 211 or the second support side wall 212, and the first locking portion 311 is capable of being connected to the first locking fitting portion 312. The support foot 21 is a square support foot 21. The first connecting part 111 and the first extension part 112 extend in different directions. The first connecting part 111 and the first extension part 112 are arranged at an obtuse angle, a right angle or an acute angle, so that the first connecting part 111 is capable of abutting against the outer side of the first support side wall 211 or the outer side of the second support side wall 212, and the first locking portion 311 is capable of being connected to the first locking fitting portion 312.

In this embodiment, a total number of the first locking fitting portions 312 is multiple. The plurality of first locking fitting portions 312 are arranged in sequence from top to bottom along the support foot 21. The first locking portion 311 is selectively connected to one of the plurality of first locking fitting portions 312. Through the above structure, the plurality of first locking fitting portions 312 can be connected to the first locking portions 311 of the plurality of support arms 11, so as to complete the installation of multi-layer support arms 11 and increase a total number of layers of the shelf. Moreover, the first locking portion 311 is selectively connected to one of the plurality of first locking fitting portions 312 to adjust an installation position of the support arm 11, thereby adjusting a height between layers of the shelf.

In this embodiment, a total number of the second locking fitting portions 314 is multiple. The plurality of second locking fitting portions 314 are arranged in sequence from top to bottom along the support foot 21. The second locking portion 313 is selectively connected to one of the plurality of second locking fitting portions 314. Through the above structure, the plurality of second locking fitting portions 314 can be connected to the second locking portions 313 of the plurality of support arms 11, so as to complete the installation of multi-layer support arms 11 and increase the total number of layers of the shelf. Moreover, the second locking portion 313 is selectively connected to one of the plurality of second locking fitting portions 314 to adjust the installation position of the support arm 11, thereby adjusting the height between layers of the shelf.

In this embodiment, the first locking fitting portion 312 is a first locking opening 3121, and the second locking fitting portion 314 is a second locking opening 3141. The first locking opening 3121 and the second locking opening 3141 have an identical shape. Through the above structure, due to the identical shape of the first locking opening 3121 and the second locking opening 3141, it is easy to install the first locking portion 311 and the second locking portion 313, easy to adjust the installation position of the support arm 11, and also easy to install the plurality of support arms 11 on the shelf.

In this embodiment, the shelf further includes a first stop side wall 5. The first connecting side wall 315 is connected to an upper side of a first elastic wall 3111. The first stop side wall 5 is connected to a lower side of the first elastic wall 3111. When the first elastic wall 3111 is inserted into the first locking opening 3121, and the first elastic wall 3111 is squeezed and locked onto an inner wall of the first locking opening 3121, the first stop side wall 5 is stopped outside the first locking opening 3121. The shelf further includes a second stop side wall 51, the first connecting side wall 315 is connected to a lower side of the second elastic wall 3132, and the second stop side wall is connected to an upper side of the second elastic wall 3132. When the second elastic wall 3132 is inserted into the second locking opening 3141, and the second elastic wall 3132 is squeezed and locked onto an inner wall of the second locking opening 3141, the second stop side wall is stopped outside the second locking opening 3141. Through the above structure, due to the arrangement of the first stop side wall 5 and the second stop side wall, the first elastic wall 3111 can be prevented from being excessively inserted into the first locking opening 3121, and the second elastic wall 3132 can be prevented from being excessively inserted into the second locking opening 3141. At the same time, when the user needs to disassemble the shelf, the first elastic wall 3111 can be removed from the first locking opening 3121 by moving the first stop side wall 5, and the second elastic wall 3132 can be removed from the second locking opening 3141 by moving the second stop side wall, making it easier for the user to disassemble the shelf.

In this embodiment, a first spacing is defined between the first locking portion 311 and the second locking portion 313, and a range of the first spacing is 1 mm-1000 mm. A length range of the first locking portion 311 is 1 mm-1000 mm, and a width range of the first locking portion 311 is 1 mm-1000 mm. A length range of the second locking portion 313 is 1 mm-1000 mm, and a width range of the second locking portion 313 is 1 mm-1000 mm. A length range of the first locking opening 3121 is 1 mm-1000 mm, and a width range of the first locking opening 3121 is 1 mm-1000 mm. A length range of the second locking opening 3141 is 1 mm-1000 mm, and a width range of the second locking opening 3141 is 1 mm-1000 mm. The first locking portion and the second locking portion have a thickness range of 0.1 mm-1000 mm. Through the above structure, the size range is set reasonably and can meet the usage needs of the user in different scenes.

In this embodiment, the first elastic gap 3114 and the second elastic gap 3135 are positioned in a first side of the first connecting part 111, and the third elastic gap 3153 is positioned in a second side of the first connecting part 111. The first hook 3131 and the second hook each include a second extension part 31311 and a stop portion 31312. The second extension part 31311 is connected to the first connecting side wall 315. The stop portion 31312 is connected to the second extension part 31311. A first hanging space 31313 for hanging the first hook 3131 on the second locking opening 3141 is surrounded and formed between the stop portion 31312, the second extension part 31311, and the first connecting side wall 315. The inner wall of the second locking opening 3141 is positioned between the stop portion 31312 and the first connecting side wall 315. Moreover, when the first elastic wall 3111 is connected to the first locking opening 3121, and the first elastic wall 3111 is squeezed and locked onto the inner wall of the first locking opening 3121, the second extension part 31311 of the first hook 3131 is pressed against the inner wall of the second locking opening 3141. Furthermore, the support foot 21 is a hollow support foot 21. Through the above structure, the hollow support foot 21 can save a molding material of the support foot 21, reduce a self weight of the support foot 21, and facilitate the transportation of the support foot 21. Specifically, the stop portion of the first hook extends towards the second hook, and the stop portion of the second hook extends towards the first hook.

Figure 25:
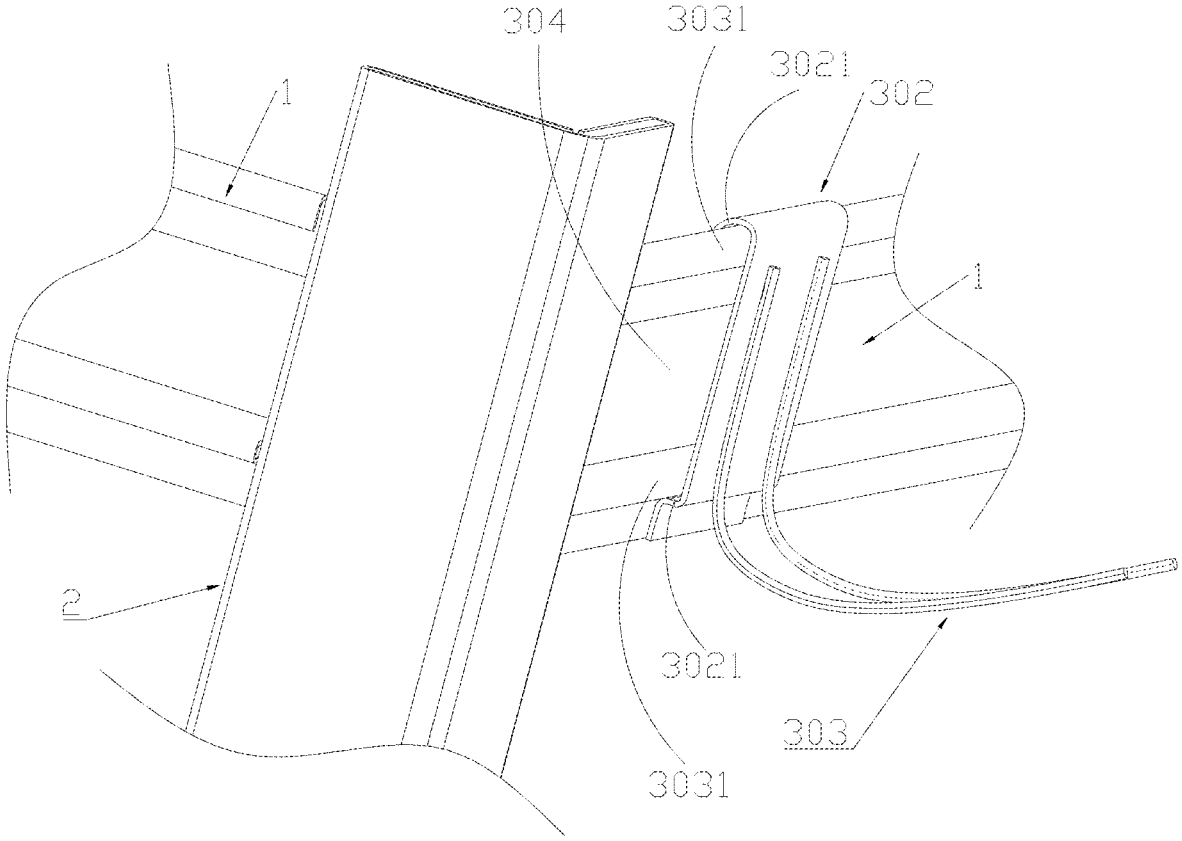
FIG. 25 is a schematic structural diagram of a sliding member and a hook.
Figure 26:
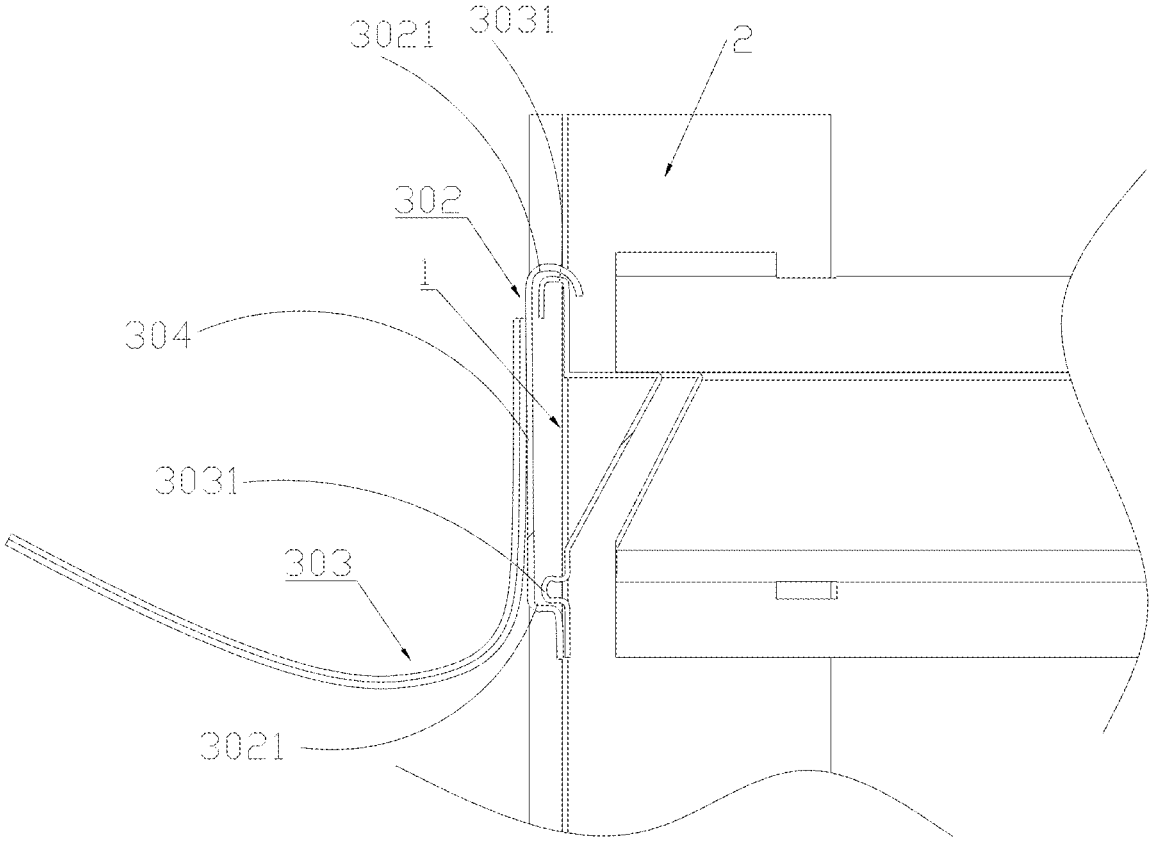
FIG. 26 is a sectional view taken along a sliding member.

Referring to FIGS. 25-26, in this embodiment, the shelf further includes a sliding member 302 and a hook 303. The sliding member is slidable on the support arm, and the hook is connected to the sliding member. A sliding groove 3021 is defined in the sliding member. The support arm is provided with a sliding rail 3031. The sliding groove is connected to the sliding rail to allow the sliding member to slide on the sliding rail. A total number of the sliding grooves is two, and a total number of the sliding rails is two. The two sliding rails are respectively positioned on an upper side and a lower side of the support arm. The two sliding grooves are respectively positioned in an upper side and a lower side of the sliding member. The hook is connected to a surface 304 of the sliding member. The hook is integrally formed and connected with or detachably connected to or welded to the sliding member. Through the above structure, since the sliding member is slidable on the support arm, and the hook is connected to the sliding member, the user can slide and adjust a position of the hook, making it easier for the user to use the hook to hang items at different positions.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A shelf, comprising:

at least one support arm part;

at least one support foot part, wherein the at least one support foot part is configured for supporting the at least one support arm part; and a locking device, wherein the locking device is configured for detachably locking the at least one support arm part to the at least one support foot part;

wherein the at least one support foot part comprises support feet; the at least one support arm part comprises support arms; the locking device comprises locking parts; the locking part comprises a first locking portion and a first locking fitting portion; the first locking portion is provided on the support arm; the first locking fitting portion is provided on the support foot; and the first locking portion is connected to the first locking fitting portion to lock the support arm to the support foot;

wherein the first locking portion is a first elastic wall, the first locking fitting portion is a first locking opening, the first elastic wall is connected to the first locking opening, and the first elastic wall is configured to be squeezed and locked onto an inner wall of the first locking opening;

wherein the locking part further comprises a second locking portion and a second locking fitting portion, the second locking portion is provided on the support arm, the second locking fitting portion is provided on the support foot, and the second locking portion is connected to the second locking fitting portion to lock the support arm to the support foot; the shelf further comprises a first connecting side wall, and the first locking portion and the second locking portion are connected by the first connecting side wall;

wherein the second locking portion is a first hook, the second locking fitting portion is a second locking opening, the first hook is hung on the second locking opening, and when the first elastic wall is connected to the first locking opening, and the first elastic wall is squeezed and locked onto an inner wall of the first locking opening, the first connecting side wall tightens the first hook towards a direction of the first elastic wall, so that the first connecting side wall presses the first hook against an inner wall of the second locking opening.

2. The shelf according to claim 1, wherein the at least one support foot part is provided with a plurality of support feet; the at least one support arm part comprises a plurality of support arms; the locking device comprises a plurality of locking parts; and the support feet and the support arms are detachably connected through the locking parts, so that the plurality of support feet and the plurality of support arms are connected to each other and combined into a whole.

3. The shelf according to claim 1, wherein the first elastic wall comprises a protruding first side wall and a protruding second side wall, the first side wall is connected to the second side wall, the first side wall and the second side wall are arranged at an obtuse angle, an acute angle or a right angle, and a first elastic gap is defined between the first side wall and the second side wall; alternatively, the first elastic wall comprises a protruding first side wall and a protruding second side wall, the first side wall is connected to the second side wall, and the first side wall and the second side wall abut against each other.

4. The shelf according to claim 1, wherein the locking part further comprises a second locking portion and a second locking fitting portion, the second locking portion is provided on the support arm, the second locking fitting portion is provided on the support foot, and the second locking portion is connected to the second locking fitting portion to lock the support arm to the support foot; the shelf further comprises a first connecting side wall, and the first locking portion and the second locking portion are connected by the first connecting side wall.

5. The shelf according to claim 1, wherein the first connecting side wall comprises a first connecting wall and a second connecting wall, the first connecting wall is connected to the first locking portion, the second connecting wall is connected to the second locking portion, the first connecting wall is connected to the second connecting wall, the first connecting wall and the second connecting wall are arranged at an obtuse angle, an acute angle or a right angle, and a third elastic gap is defined between the first connecting wall and the second connecting wall.

6. The shelf according to claim 1, wherein the support arm is provided with first connecting parts, a first extension part, and a support part; two ends of the first extension part are each connected to one of the first connecting parts, and the first locking portion is provided on the first connecting part; the support part is configured for supporting a storage board, and the support part extends from the first extension part and/or the first connecting part.

7. The shelf according to claim 6, wherein the first connecting part and the first extension part are integrally formed and connected; alternatively, the first connecting part and the first extension part are detachably connected; alternatively, the first connecting part and the first extension part are fixedly connected.

8. The shelf according to claim 1, wherein the support foot comprises a first support side wall and a second support side wall; the first support side wall is connected to the second support side wall; the first support side wall and the second support side wall are arranged at an obtuse angle, a right angle, or an acute angle; and the first support side wall and the second support side wall are both equipped with first locking fitting portions.

9. The shelf according to claim 4, wherein a total number of the first locking fitting portions is multiple, the plurality of first locking fitting portions are arranged in sequence from top to bottom along the support foot, and the first locking portion is selectively connected to one of the plurality of first locking fitting portions; a total number of the second locking fitting portions is multiple, the plurality of second locking fitting portions are arranged in sequence from top to bottom along the support foot, and the second locking portion is selectively connected to one of the plurality of second locking fitting portions; the first locking fitting portion is a first locking opening, the second locking fitting portion is a second locking opening, and the first locking opening and the second locking opening have an identical shape; a first spacing is defined between the first locking portion and the second locking portion, and a range of the first spacing is 1 mm-1000 mm; a length range of the first locking portion is 1 mm-1000 mm, and a width range of the first locking portion is 1 mm-1000 mm; a length range of the second locking portion is 1 mm-1000 mm, and a width range of the second locking portion is 1 mm-1000 mm; the first locking portion and the second locking portion have a thickness range of 0.1 mm-1000 mm.

10. The shelf according to claim 1, further comprising a sliding member and a hook, wherein the sliding member is slidable on the support arm, and the hook is connected to the sliding member.

11. A shelf, comprising:

at least one support arm part;

at least one support foot part, wherein the at least one support foot part is configured for supporting the at least one support arm part; and a locking device, wherein the locking device is configured for detachably locking the at least one support arm part to the at least one support foot part;

wherein the at least one support foot part comprises support feet; the at least one support arm part comprises support arms; the locking device comprises locking parts; the locking part comprises a first locking portion and a first locking fitting portion; the first locking portion is provided on the support arm; the first locking fitting portion is provided on the support foot; and the first locking portion is connected to the first locking fitting portion to lock the support arm to the support foot;

wherein the first locking portion is a first elastic wall, the first locking fitting portion is a first locking opening, the first elastic wall is connected to the first locking opening, and the first elastic wall is configured to be squeezed and locked onto an inner wall of the first locking opening;

wherein the locking part further comprises a second locking portion and a second locking fitting portion, the second locking portion is provided on the support arm, the second locking fitting portion is provided on the support foot, and the second locking portion is connected to the second locking fitting portion to lock the support arm to the support foot; the shelf further comprises a first connecting side wall, and the first locking portion and the second locking portion are connected by the first connecting side wall;

wherein the shelf further comprises a first stop side wall, wherein the first connecting side wall is connected to an upper side of a first elastic wall; the first stop side wall is connected to a lower side of the first elastic wall; and when the first elastic wall is inserted into a first locking opening, and the first elastic wall is squeezed and locked onto an inner wall of the first locking opening, the first stop side wall is stopped outside the first locking opening.

* * * * *